US009414145B2

(12) United States Patent
Oishi et al.

(10) Patent No.: US 9,414,145 B2
(45) Date of Patent: Aug. 9, 2016

(54) CUSTOMIZABLE HEADPHONE AUDIO DRIVER ASSEMBLY, HEADPHONE INCLUDING SUCH AN AUDIO DRIVER ASSEMBLY, AND RELATED METHODS

(71) Applicant: Skullcandy, Inc., Park City, UT (US)

(72) Inventors: Tetsuro Oishi, Park City, UT (US); Rex Price, Saratoga Springs, UT (US); Matt Windt, Heber City, UT (US); Thomas C. Burton, Sandy, UT (US)

(73) Assignee: Skullcandy, Inc., Park City, UT (US)

( * ) Notice: Subject to any disclaimer, the term of this patent is extended or adjusted under 35 U.S.C. 154(b) by 484 days.

(21) Appl. No.: 13/833,942

(22) Filed: Mar. 15, 2013

(65) Prior Publication Data

US 2014/0270228 A1 Sep. 18, 2014

(51) Int. Cl.

| | |
|---|---|
| ***H04R 1/10*** | (2006.01) |
| *H04R 1/28* | (2006.01) |
| *H04R 5/033* | (2006.01) |

(52) U.S. Cl.

CPC ..... *H04R 1/10* (2013.01); *H04R 1/1033* (2013.01); *H04R 1/1075* (2013.01); *H04R 1/1008* (2013.01); *H04R 1/2803* (2013.01); *H04R 1/2811* (2013.01); *H04R 5/033* (2013.01)

(58) Field of Classification Search

None

See application file for complete search history.

(56) References Cited

U.S. PATENT DOCUMENTS

| | | | |
|---|---|---|---|
| 5,555,554 | A | 9/1996 | Hofer et al. |
| 6,466,681 | B1 | 10/2002 | Siska et al. |
| 7,187,948 | B2 | 3/2007 | Alden |
| 7,395,090 | B2 | 7/2008 | Alden |
| D623,627 | S | 9/2010 | Alden et al. |
| D624,057 | S | 9/2010 | Kelly et al. |
| D641,003 | S | 7/2011 | Alden |
| 8,014,824 | B2 | 9/2011 | Alden |
| D650,356 | S | 12/2011 | Alden et al. |
| D656,129 | S | 3/2012 | Kelly et al. |
| D665,776 | S | 8/2012 | Alden et al. |
| D665,777 | S | 8/2012 | Alden et al. |
| D673,136 | S | 12/2012 | Kelly et al. |

(Continued)

FOREIGN PATENT DOCUMENTS

| | | |
|---|---|---|
| CA | 2515558 A1 | 2/2007 |
| CA | 2697029 A1 | 2/2007 |

(Continued)

OTHER PUBLICATIONS

European Search Report for European Application No. 14159683.3, dated Sep. 24, 2014, 8 pages.

*Primary Examiner* — Thang Tran

(74) *Attorney, Agent, or Firm* — TraskBritt

(57) ABSTRACT

Headphones include removable audio drivers electrically coupled with electrical conductors using solderless and detachable interconnections. Driver assemblies for headphones include an audio driver and a driver unit housing. An acoustical cavity is defined between the driver unit housing and the audio driver, and a port extends through the driver unit housing between the acoustical cavity and the exterior of the driver assembly. The driver unit housing is configured to be secured within an outer ear-cup housing of a headphone such that the port is open to the exterior of the headphone without communicating acoustically with a volume outside the driver unit housing and within the outer ear-cup housing. Headphones include such driver assemblies. Methods are used to form such headphones and driver assemblies.

14 Claims, 17 Drawing Sheets

(56) References Cited

U.S. PATENT DOCUMENTS

| | | | | |
|---|---|---|---|---|
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| D685,759 | S | 7/2013 | Kelly et al. | |
| D685,767 | S | 7/2013 | Kelly et al. | |
| D689,464 | S | 9/2013 | Bonahoom et al. | |
| D691,582 | S | 10/2013 | Nguyen et al. | |
| D693,793 | S | 11/2013 | Kelly et al. | |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| 2005/0105755 | A1* | 5/2005 | Yueh | H04R 1/1041 381/371 |
| 2006/0104471 | A1* | 5/2006 | Tsunoda | H04R 1/1041 381/374 |
| 2006/0165249 | A1* | 7/2006 | Sato | B06B 1/045 381/374 |
| 2007/0142025 | A1 | 6/2007 | Alden | |
| 2007/0154049 | A1* | 7/2007 | Levitsky | H04R 1/1083 381/371 |
| 2008/0267440 | A1 | 10/2008 | Alden | |
| 2011/0164776 | A1 | 7/2011 | Kelly et al. | |
| 2011/0235819 | A1 | 9/2011 | Alden | |
| 2012/0099755 | A1* | 4/2012 | Hu | H04R 1/1066 381/380 |
| 2012/0128172 | A1 | 5/2012 | Alden | |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1* | 7/2013 | Sze | H04R 1/1033 381/384 |
| 2013/0185905 | A1 | 7/2013 | Stiff et al. | |
| 2013/0208909 | A1 | 8/2013 | Mülder et al. | |
| 2013/0272560 | A1* | 10/2013 | Dougherty | H04R 1/1066 381/378 |
| 2013/0336514 | A1 | 12/2013 | Kelly et al. | |
| 2014/0056459 | A1 | 2/2014 | Oishi et al. | |
| 2014/0105414 | A1* | 4/2014 | Rois | H04R 1/1091 381/74 |
| 2014/0169579 | A1* | 6/2014 | Azmi | G10K 11/16 381/71.6 |
| 2014/0177884 | A1* | 6/2014 | Minarik | H04R 1/1066 381/309 |

FOREIGN PATENT DOCUMENTS

| | | |
|---|---|---|
| EP | 1760896 | 9/2010 |
| EP | 2262117 | 12/2010 |
| WO | 2010068495 | 6/2010 |
| WO | 2010124190 | 10/2010 |
| WO | 2011085096 | 7/2011 |
| WO | 2012024656 | 2/2012 |

* cited by examiner

CUSTOMIZABLE HEADPHONE AUDIO DRIVER ASSEMBLY, HEADPHONE INCLUDING SUCH AN AUDIO DRIVER ASSEMBLY, AND RELATED METHODS

FIELD

Embodiments of the disclosure generally relate to headphones, to headphone driver assemblies for use in headphones, and to methods of making such headphones and driver assemblies.

BACKGROUND

Conventional headphones include one or two speaker assemblies, each having an audio driver that produces audible sound waves using a magnet, coil, and diaphragm. Each speaker assembly is mounted in an ear-cup housing, and a foam or other soft material is provided on the side of the ear-cup housing that will abut against the ear and/or head of a person wearing the headphone. The positive and negative electrical terminals for the audio driver are respectively soldered to ends of wires, which extend to an audio jack (e.g., a tip-sleeve (TS) connector, a tip-ring-sleeve (TRS) connector, a tip-ring-ring-sleeve (TRRS) connector, etc.). The audio jack may be coupled to a media player such as a mobile phone, a digital media player, a computer, a television, etc., and the audio signal is transmitted to the audio driver in the speaker assembly within the headphone through the wires. Thus, the driver is permanently installed within the headphone, and is not configured to be removed without destructing the permanent solder coupling of the wires to the terminals of the audio driver.

The acoustic performance of a headphone is conventionally a function of both the audio driver, as well as the configuration of the speaker assembly and the ear-cup housing within which the driver is disposed. The speaker assembly and the ear-cup housing of conventional headphones typically define acoustical cavities that affect the acoustics of the headphone. Thus, the manufacturer of the headphones may design the ear-cup housing and speaker assembly of a headphone, for use with a selected audio driver, so as to provide the headphone with acoustics deemed desirable by the manufacturer.

BRIEF SUMMARY

In some embodiments, the present disclosure includes a headphone having a removable audio driver. The driver may have terminals electrically coupled to electrical conductors that are configured to carry an electrical audio signal to the audio driver. The terminals of the audio driver may be coupled to the electrical conductors with a solderless and detachable electrical coupling.

In additional embodiments, the present disclosure includes a headphone having an audio driver, and a cap coupled directly to the audio driver and disposed over a back side of the audio driver. The audio driver has terminals electrically coupled to electrical conductors configured to carry an electrical audio signal to the audio driver.

In additional embodiments, the present disclosure includes a driver assembly for a headphone. The driver assembly includes an audio driver, and a driver unit housing attached to the audio driver. The driver unit housing defines an acoustical cavity between the driver unit housing and the audio driver, and the driver unit housing has a port extending through the driver unit housing between the acoustical cavity and the exterior of the driver assembly. The driver unit housing is configured to be secured within an outer ear-cup housing of a headphone such that the port in the driver unit housing is open to the exterior of the headphone without communicating acoustically with any volume outside the driver assembly within the outer ear-cup housing of the headphone.

In additional embodiments, the present disclosure includes a headphone having an outer ear-cup housing and a driver assembly disposed within the outer ear-cup housing. The driver assembly includes an audio driver attached to a driver unit housing. The driver unit housing defines an acoustical cavity between the driver unit housing and the audio driver. The driver unit housing has a port extending through the driver unit housing between the acoustical cavity and the exterior of the driver unit housing without communicating acoustically with a volume of space inside the outer ear-cup housing and outside the driver assembly.

In yet further embodiments, the present disclosure includes methods of making headphones and driver assemblies for use in headphones as described herein.

For example, in some embodiments, the disclosure includes a method of forming a headphone in which electrical terminals of an audio driver are detachably and solderlessly coupled to electrical conductors within an outer ear-cup housing of a headphone, wherein the electrical conductors are configured to carry an electrical audio signal to the audio driver.

In additional embodiments, a method of forming a driver assembly for a headphone includes attaching an audio driver to a driver unit housing and providing an acoustical cavity between the driver unit housing and the audio driver. The driver unit housing has a port extending through the driver unit housing between the acoustical cavity and the exterior of the driver assembly, and the driver unit housing is configured to be secured within an outer ear-cup housing of a headphone such that the port in the driver unit housing is open to the exterior of the headphone without communicating acoustically with any volume outside the driver unit housing within the outer ear-cup housing of the headphone.

In yet further embodiments, the disclosure includes a method of forming a headphone in which an audio driver is attached to a driver unit housing, and an acoustical cavity is provided between the driver unit housing and the audio driver. The driver unit housing has a port extending through the driver unit housing between the acoustical cavity and the exterior of the driver unit housing. The audio driver and the driver unit housing are secured within an outer ear-cup housing such that the port in the driver unit housing is open to the exterior of the headphone without communicating acoustically with any volume within the outer ear-cup housing of the headphone outside the acoustical cavity.

This summary does not limit the scope of the invention, and is not intended to identify key features or aspects of the invention, but merely provides a generalized description of the nature of the subject matter disclosed herein. The scope of the invention is defined by the claims and their legal equivalents.

BRIEF DESCRIPTION OF THE DRAWINGS

The present disclosure may be understood more fully by reference to the following detailed description of example embodiments, which are illustrated in the appended figures in which.

DETAILED DESCRIPTION

The illustrations presented herein are not meant to be actual views of any particular headphone, speaker assembly, driver unit, or component thereof, but are merely simplified schematic representations employed to describe illustrative embodiments. Thus, the drawings are not necessarily to scale.

As used herein, the term "media player" means and includes any device or system capable of producing an audio signal and wired or wirelessly connectable to a speaker to convert the audio signal to audible sound. For example and without limitation, media players include portable digital music players, portable compact disc players, portable cassette players, mobile phones, smartphones, personal digital assistants (PDAs), radios (e.g., AM, FM, HD, and satellite radios), televisions, ebook readers, portable gaming systems, portable DVD players, laptop computers, tablet computers, desktop computers, stereo systems, and other devices or systems that may be created hereafter.

As used herein, the term "emitted sound pressure level (SPL) profile" means and includes sound pressure levels over a range of frequencies, as measured in dB (SPL) per 1 mW, of audio signals as emitted by a sound source (e.g., a speaker).

As used herein, the term "detectable sound pressure level (SPL) profile" means and includes sound pressure levels over a range of frequencies of audio signals as detectable or detected by a user of modular audio headphone device, as measured in dB (SPL) per 1 mW. Detectable SPL profiles may be measured using commercially available testing equipment and software. For example, detectable SPL profiles may be obtained using, for example, the Head and Torso Simulator ("HATS") Type 4128C and Ear Part Number 4158-C commercially available from Brüel & Kjer Sound & Vibration Measurement A/S of Nærum, Denmark, in conjunction with sound test and measurement software, such as SOUNDCHECK® 10.1, which is commercially available from Listen, Inc. of Boston, Mass.

Figure 1:
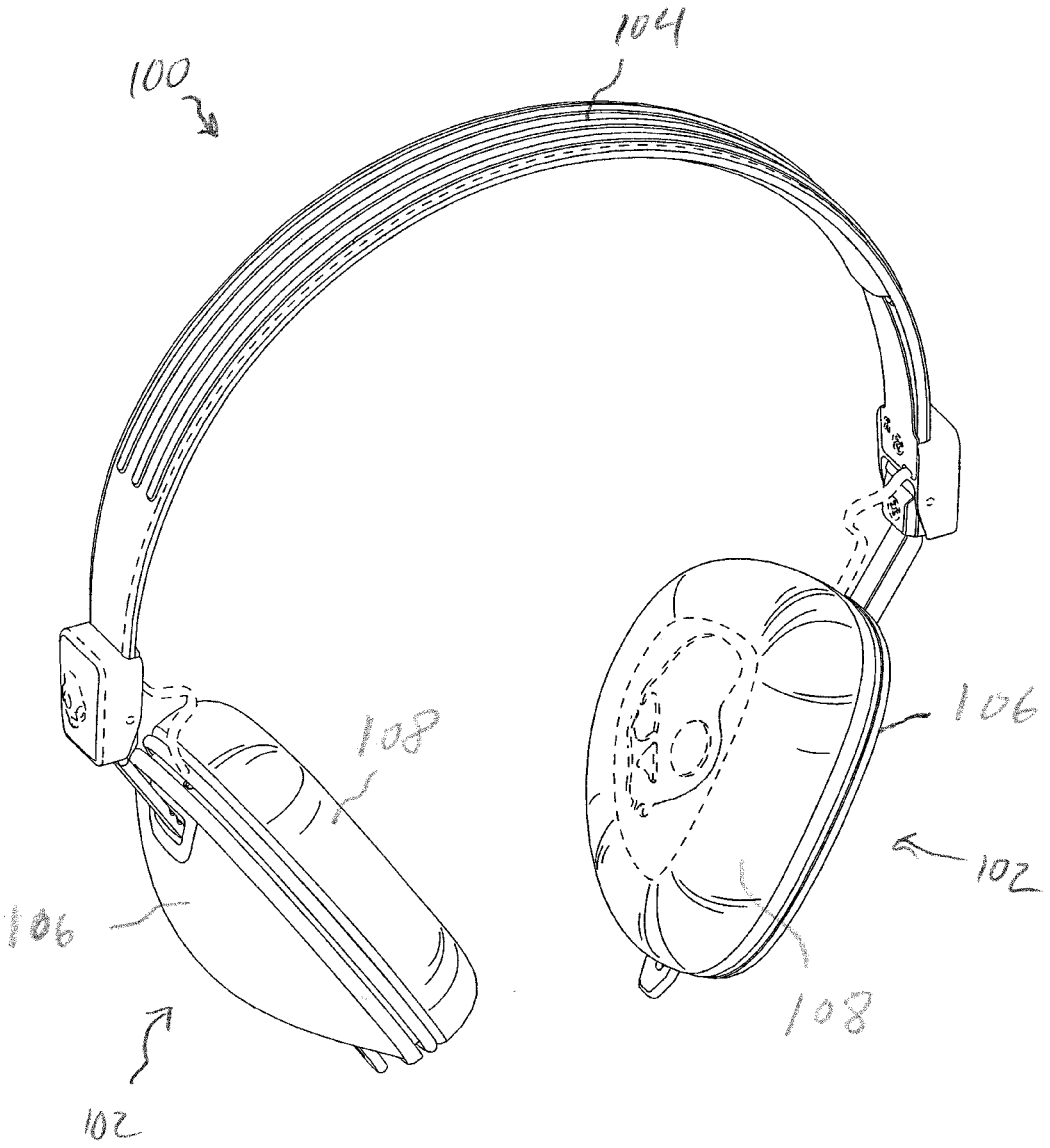
FIG. 1 is a perspective view of an embodiment of a headphone of the present disclosure.

FIG. 1 is a perspective view of a headphone 100 that includes a removable audio driver, as discussed in further detail below. The headphone 100 has two ear-cup assemblies 102 that are connected with a headband 104, which rests on the head of the user and supports the ear-cup assemblies 102 over or on the ears of the user. Each ear-cup assembly 102 includes an outer ear-cup housing 106, and may include a cushion 108 attached to or otherwise carried on the outer ear-cup housing 106. The headphone 100 may be configured to receive an electronic audio signal from a media player, either through a wired connection or a wireless connection between the headphone 100 and the media player.

Figure 2A:
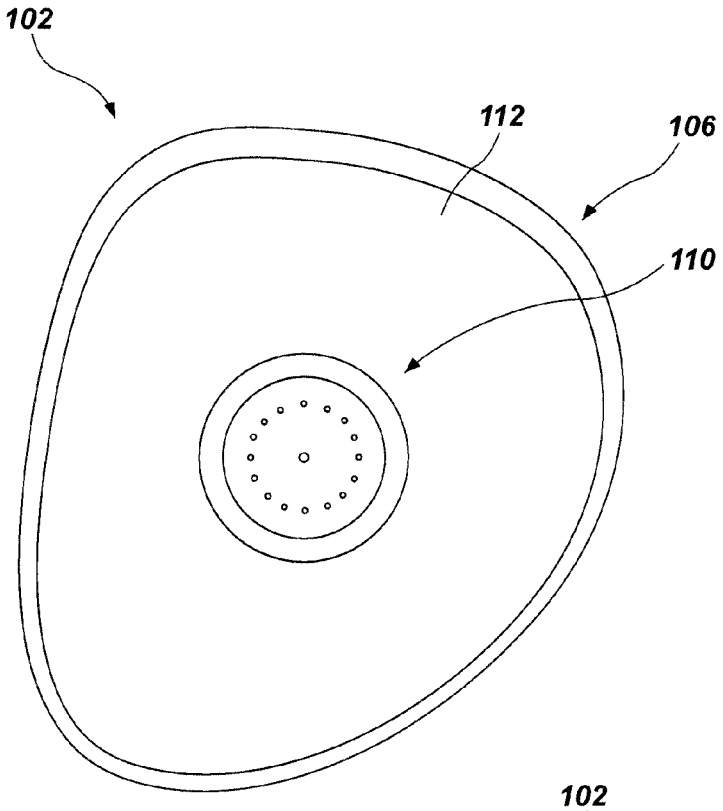
FIG. 2A is a cross-sectional view of an ear-cup assembly of the headphone of FIG. 1 showing a removable audio driver disposed therein.
Figure 2B:
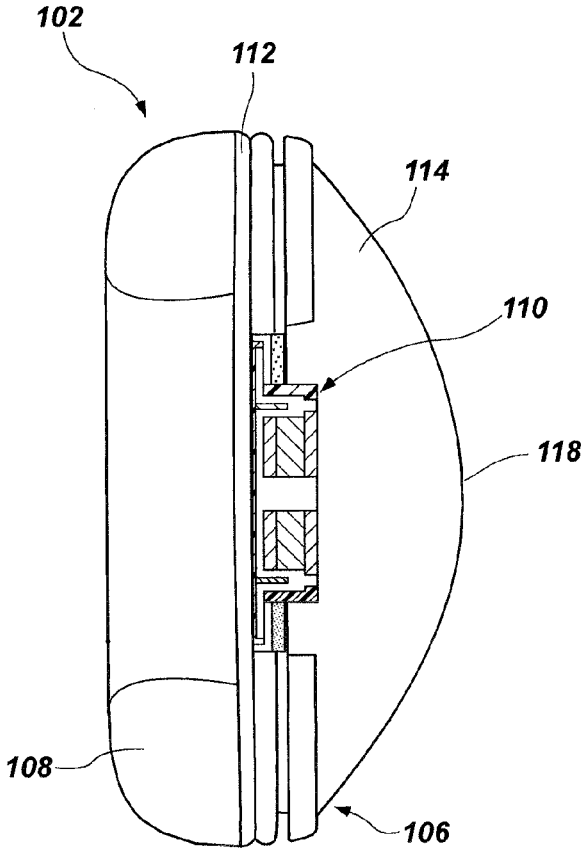
FIG. 2B is a cross-sectional view of the ear-cup assembly of FIG. 2A in a plane transverse to the plane of view of FIG. 2A, and further illustrates the removable audio driver within the ear-cup assembly.

FIGS. 2A and 2B illustrate an audio driver 110 within one of the ear-cup assemblies 102. As shown in FIG. 2B, the outer ear-cup housing 106 may include two or more members that are assembled together around the audio driver 110. As a non-limiting example, the outer ear-cup housing 106 may include a front member 112 and a back member 114. The various members of the outer ear-cup housing 106 may be formed from, for example, plastic or metal, and may serve as a frame structure for the ear-cup assembly 102.

In accordance with some embodiments of the present invention, the audio driver 110 may be configured to be removable from the ear-cup assembly 102 without destructing any portion of the headphone 100 so as to allow the audio driver 110 to be repeatedly removed and replaced by a manufacturer of the headphone 100, a person servicing or repairing the headphone 100, and/or by a person using the headphone 100. Thus, in some embodiments, portion of the outer ear-cup housing 106 may be easily removable to provide access to the audio driver 110. As a non-limiting example, the back member 114 of the outer ear-cup housing 106 may be or include a plastic cover 118 that may be removed and replaced, or opened and closed, so as to allow access to the audio driver 110 within the ear-cup assembly 102.

In contrast to previously known headphones, wherein wires are permanently soldered to the electrical contacts of the audio drivers therein, the removable audio driver 110 of the present disclosure may have electrical terminals that are electrically coupled to electrical conductors configured to carry an electrical signal to the audio driver 110 (such as wires, for example) using a solderless and detachable electrical coupling therebetween.

Figure 3:
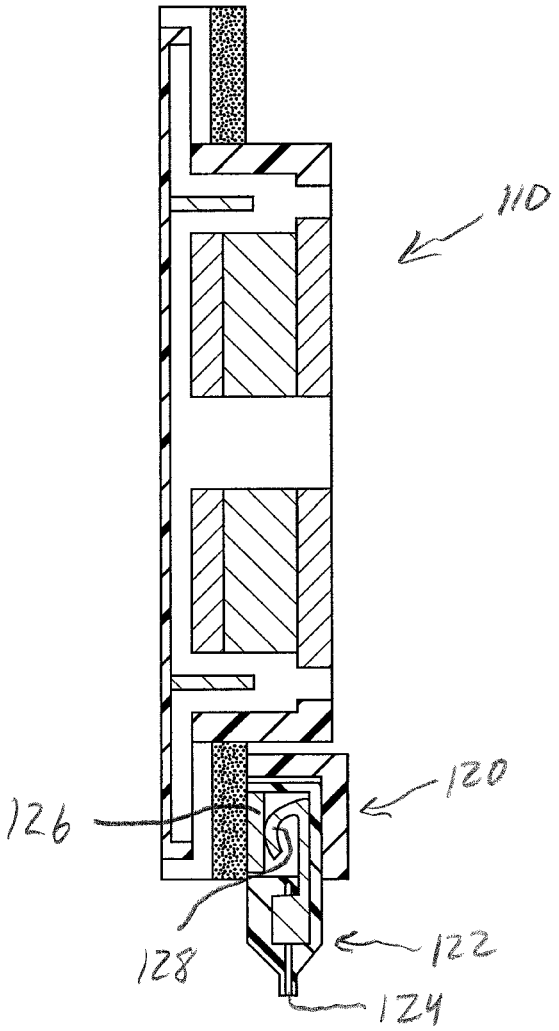
FIG. 3 is a simplified cross-sectional view illustrating a plug-and-receptable coupling that includes a spring contact, which may be used to electrically couple a removable audio driver to wires or other conductors within the ear-cup assembly of FIGS. 1, 2A, and 2B.

In some embodiments, the solderless and detachable electrical coupling between the electrical terminals of the audio driver 110 and the electrical wires or other conductors may comprise a plug-and-receptacle coupling, as shown in FIG. 3. As shown therein, a female receptacle 120 may be provided on the audio driver 110, and a complementary male plug 122 may be provided on the end of a wire or wire 124. The female receptacle 120 may be associated with one or more conductive terminals 126 of the audio driver 110, such that an electrical contact 128 of the male plug 122 will contact the conductive terminals 126 of the audio driver 110 when the male plug 122 is inserted into the female receptacle 120. The electrical contact 128 of the male plug 122 may comprise one or more spring contact structures, such as a flexible metal spring structure, that is compressed against the conductive terminals 126 of the audio driver 110 when the male plug 122 is inserted into the female receptacle 120. The electrical contact 128 may comprise, for example, a metal spring structure that is crimped to an end of the wire 124, and a body made of, e.g., a polymer, may be molded over and around the end of the wire 124 and the electrical contact 128 of the male plug 122.

Of course, in additional embodiments, the positions of the male plug 122 and female receptacle 120 may be revised, such that the male plug 122 is provided on or with the audio driver 110 and the female receptacle 120 is provided on or with the wires 124.

Figure 4:
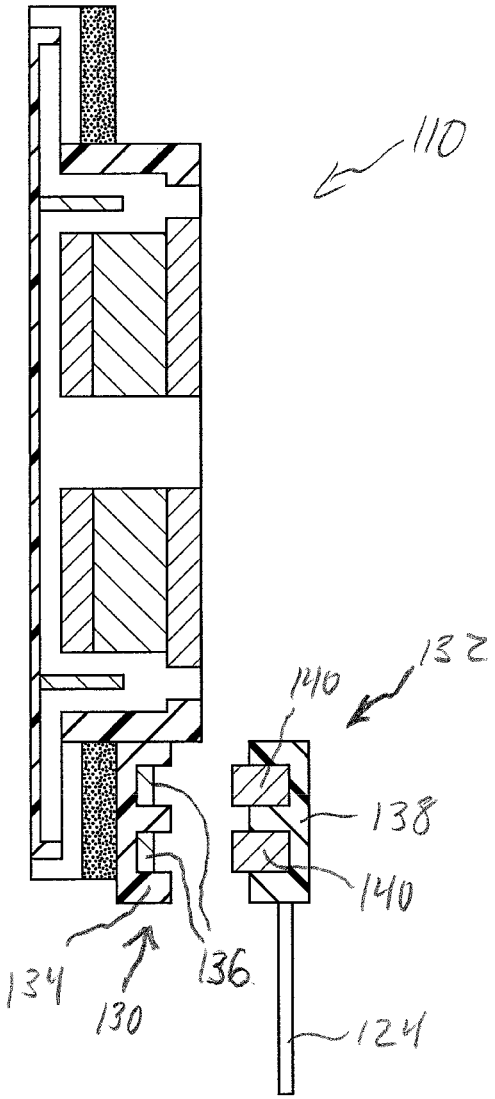
FIG. 4 is a simplified cross-sectional view illustrating a magnetic coupling that may be used to electrically couple a removable audio driver to wires or other conductors within the ear-cup assembly of FIGS. 1, 2A, and 2B.

Referring to FIG. 4, in additional embodiments, the solderless and detachable electrical coupling between the electrical terminals of the audio driver 110 and the electrical wires or other conductors may comprise a magnetic coupling, as shown in FIG. 3. By way of example and not limitation, the magnetic coupling may comprise what is referred to in the art as a magnetic "pogo" connector. As shown in FIG. 4, a first connector 130 may be provided on the audio driver 110, and a complementary second connector 132 may be provided on the end of the wire 124 or other electrical conductors. The first connector 130 may include a dielectric (e.g., polymeric) body 134 with conductive terminals 136 thereon, and the second connector 132 also may have a dielectric (e.g., polymeric) body 138 with conductive contacts 140 thereon. The first and second connectors 130, 132, respectively, may have complementary recesses and protrusions such that at least a portion of the second connector 132 may be received in a recess in the first connector 130, or vice versa. The conductive contacts 140 contact and establish an electrical interconnection with the conductive terminals 136 when the first connector 130 and the second connector 132 are coupled together. One or both of the conductive terminals 136 and the conductive contacts 140 may comprise a magnetic material so as to magnetically attract the other of the conductive terminals 136 and the conductive contacts 140.

Figure 5:
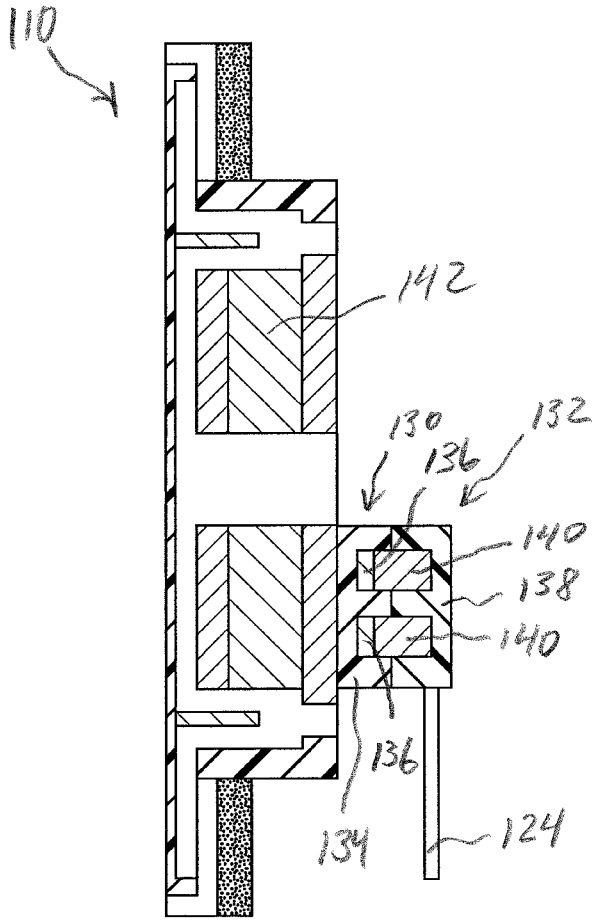
FIG. 5 is a simplified cross-sectional view illustrating another magnetic coupling that may be used to electrically couple a removable audio driver to wires or other conductors within the ear-cup assembly of FIGS. 1, 2A, and 2B, wherein the magnet of the audio driver is used to assist in the electrical coupling.

FIG. 5 illustrates another embodiment in which the solderless and detachable magnetic electrical coupling is provided between the electrical terminals of the audio driver 110 and the electrical wires or other conductors. The embodiment of FIG. 5 is similar to that of FIG. 4 and includes a first connector 130 on the audio driver 110, and a complementary second connector 132 on the end of the wire 124. As previously described, the first connector 130 includes a dielectric body 134 with conductive terminals 136 thereon, and the second connector 132 also may have a dielectric body 138 with conductive contacts 140 thereon. In the embodiment of FIG. 5, however, a magnet 142 of the audio driver 110 is used to assist in the magnetic electrical coupling. In particular, the magnet 142 comprises a permanent physical magnet, and the magnetic field of the magnet 142 may attract the conductive contacts 140 of the second connector 132 on the wire 124 and hold the second connector 132 against the first connector 130 in the interconnected configuration shown in FIG. 5.

Any other solderless and detachable electrical coupling between the audio driver 110 and the wires 124 or other conductors may be employed in accordance with additional embodiments of the disclosure, to allow the audio driver 110 to be repeatedly detached from the headphone 100 and reattached thereto as desired in a manner that does not require destruction of any component of the headphone 100.

Figure 6:
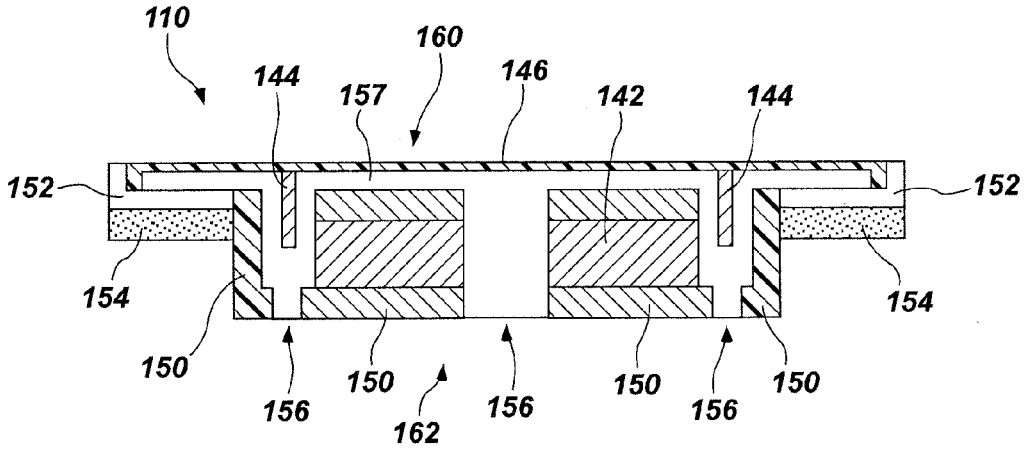
FIG. 6 is a simplified cross-sectional side view illustrating the audio driver of the headphone of FIGS. 1, 2A, and 2B.

FIG. 6 illustrates the removable audio driver 110 of FIGS. 1 through 5 separate from the headphone 100 and other components of the ear-cup assembly 102. Many configurations of audio drivers are known in the art, any of which may be adapted to be removable from an ear-cup assembly and employed in embodiments of the present disclosure. FIG. 6 illustrates just one non-limiting example of such an audio driver 110. As shown in FIG. 6, the audio driver 110 may include a permanent magnet 142 and an electrical voice coil 144 that is positioned so as to circumscribe the permanent magnet 142. The voice coil 144 is attached to a flexible diaphragm 146. The permanent magnet 142 may be supported within a yoke cup 150, which often comprises a metal. A driver basket 152, which is usually a polymeric structure, may be attached to the yoke cup 150, and the flexible diaphragm 146 may be attached to the driver basket 152. The voice coil 144 may be electrically coupled to the conductive terminals 126 (FIG. 3) of the audio driver 110. In other embodiments, the positions of the permanent magnet 142 and the voice coil 144 may be reversed.

The diaphragm 146 is positioned on a front side 160 of the audio driver 110, and the yoke cup 150 is disposed on the back side 162 of the audio driver 110.

A printed circuit board 154 may be attached to the driver basket 152, and electrical conductors and/or components of the audio driver 110 (such as the conductive terminals for the audio driver 110) may be disposed on the printed circuit board 154. As shown in FIG. 5, one or more ports 156 may extend through the yoke cup 150 and/or the permanent magnet 142 to provide an opening between the space 157 within the audio driver 110 between the diaphragm 146 and the magnet 142 and the exterior of the audio driver 110.

During operation, current is caused to flow through the voice coil 144, the magnitude of which fluctuates according to the electrical signal carried by the current. The interaction between the magnetic field of the permanent magnet 142 and the fluctuating magnetic field generated by the current flowing through the voice coil 144, results in vibration of the flexible diaphragm 146, resulting in audible sound being emitted therefrom.

Figure 7:
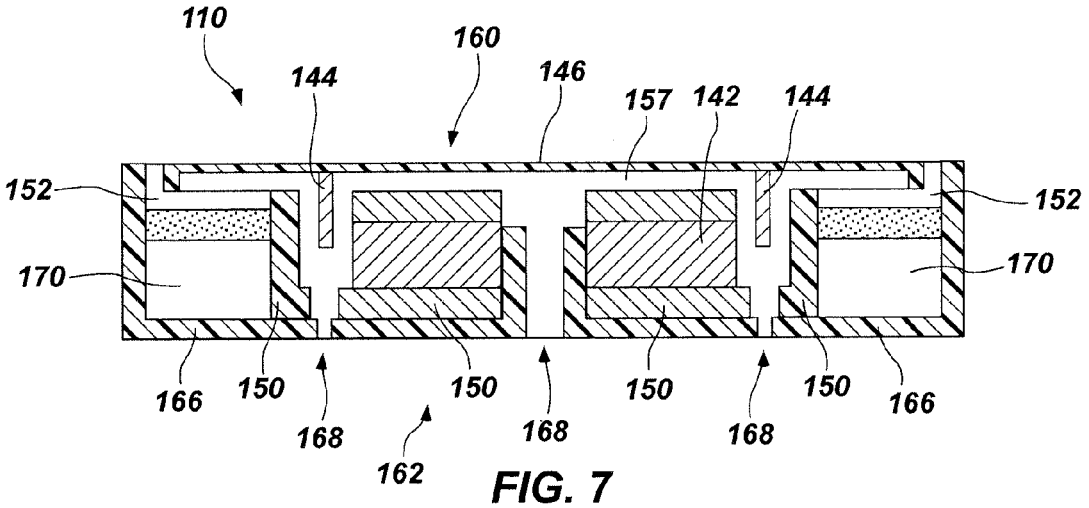
FIG. 7 is a simplified cross-sectional view illustrating another embodiment of an audio driver assembly, which includes a cap attached to an audio driver, which may be employed in the headphone of FIGS. 1, 2A, and 2B.

Referring to FIG. 7, in accordance with some embodiments of the disclosure, the audio driver of a headphone, such as the audio driver 110 of the headphone 100 of FIGS. 1 through 6, may include a cap 166 over the back side 162 of the audio driver 110. The cap 166 may be directly coupled to the audio driver 110 using, for example, an adhesive, a snap-fit, a welding process, or any other suitable method.

In some embodiments, the cap 166 may be a decorative cap that includes one or more aesthetica) decorations (e.g., graphics) thereon. In such embodiments, at least a portion of the outer ear-cup housing 106, such as a portion of the back member 114 (FIG. 2B), may be at least partially transparent, such that the cap 166 (and the aesthetic decoration thereon) over the back side 162 of the audio driver 110 is visible through at least a portion of the outer ear-cup housing 106 from the exterior of the headphone 100 (FIG. 1).

In addition or as an alternative to serving as a decoration of the audio driver 110, the cap 166 may at least partially define an acoustical cavity of the audio driver 110. The cap 166 may include one or more ports or apertures 168 extending therethrough, and the apertures 168 extending through the cap 166 may be at least partially aligned with the ports 156 in the yoke cup 150 (FIG. 6), so as to provide communication through the yoke cup 150 and the cap 166 between the space 157 within the audio driver 110 between the diaphragm 146 and the magnet 142 and the exterior of the audio driver 110. A sum of the cross-sectional areas of the apertures 168 may be less than a sum of the cross-sectional areas of the ports 156 extending through the yoke cup 150 in some embodiments. The location and configuration of the apertures 168 may be selectively tailored so as to provide a selected emitted SPL profile, and/or a detectable SPL profile, for the audio driver 110 and the headphone 100 (FIG. 1). In some embodiments, the cap 166 may be adjustable to allow a person (e.g., a manufacturer, repairer, user, etc.) to open, close, or adjust a size of the apertures 168 so as to selectively adjust an acoustic cavity of the audio driver 110, as discussed in further detail below.

Figure 8:
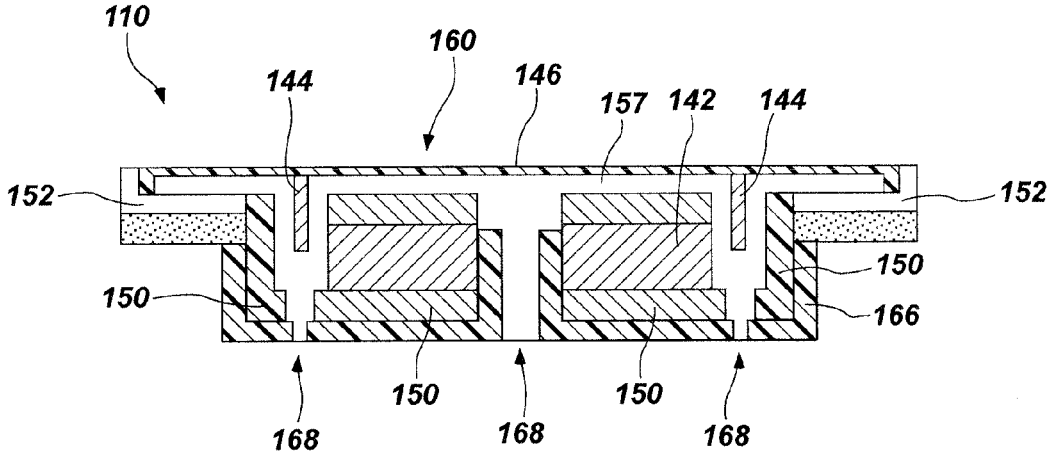
FIG. 8 is a simplified cross-sectional view illustrating another embodiment of an audio driver assembly including a cap attached to an audio driver, which may be employed in the headphone of FIGS. 1, 2A, and 2B.

In some embodiments, the cap 166 may cover the entire back side 162 of the audio driver 110, as shown in FIG. 7. In additional embodiments, the cap 166 may only cover the yoke cup 150 without entirely covering the driver basket 152, as shown in FIG. 8.

Figure 9:
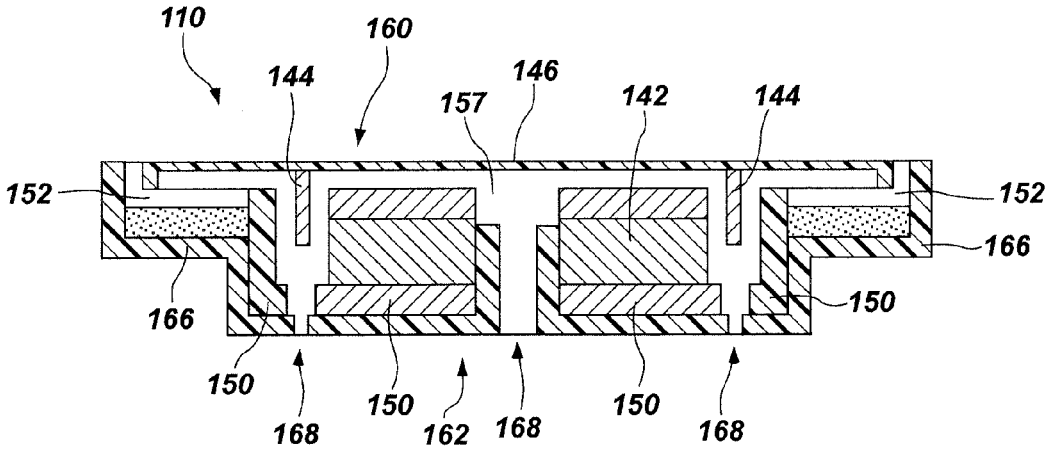
FIG. 9 is a simplified cross-sectional view illustrating another embodiment of an audio driver assembly including a cap attached to an audio driver, which may be employed in the headphone of FIGS. 1, 2A, and 2B.

In the embodiment of FIG. 7, the cap 166 has a cup shape, and a void 170 is defined within the cap 166 between the cap 166 and the driver basket 152 outside the yoke cup 150. As shown in FIG. 9, in additional embodiments, the cap 166 may fit in a conforming manner to the exposed surfaces of the yoke cup 150 and the driver basket 152, such that no such void 170 (FIG. 7) is present within the audio driver 110 while the cap 166 at least substantially covers the entire back side 162 of the audio driver 110.

Figure 10:
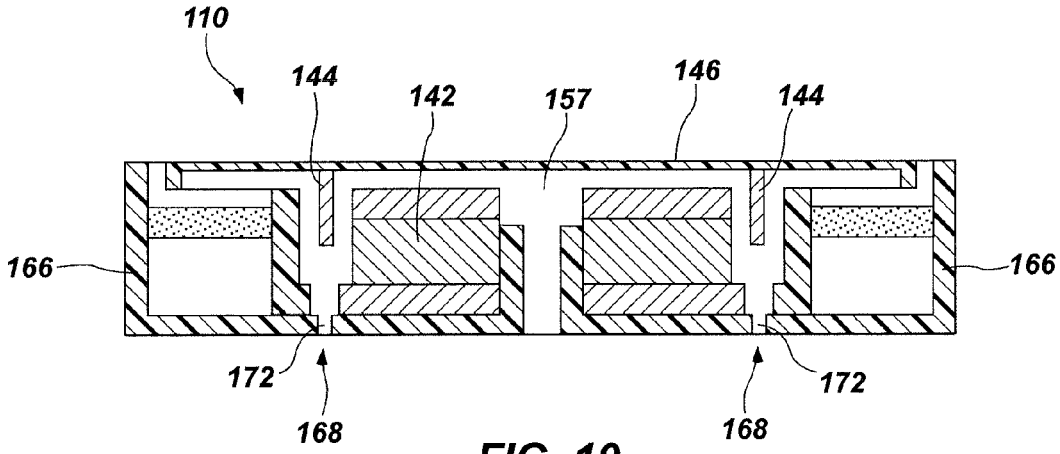
FIG. 10 is a simplified cross-sectional view illustrating another embodiment of an audio driver assembly including a cap attached to an audio driver, which may be employed in the headphone of FIGS. 1, 2A, and 2B.

As shown in FIG. 10, a damping material 172 optionally may be provided within the cap 166, such as in one or more of the apertures 168 extending through the cap 166, so as to selectively adjust the emitted SPL profile and/or the detectable SPL profile of the audio driver 110 and headphone 100 (FIG. 1). The damping material 172 may comprise, for example, a woven or non-woven material (e.g., a textile or paper) or a polymeric foam (open- or closed-cell) material.

Figure 11:
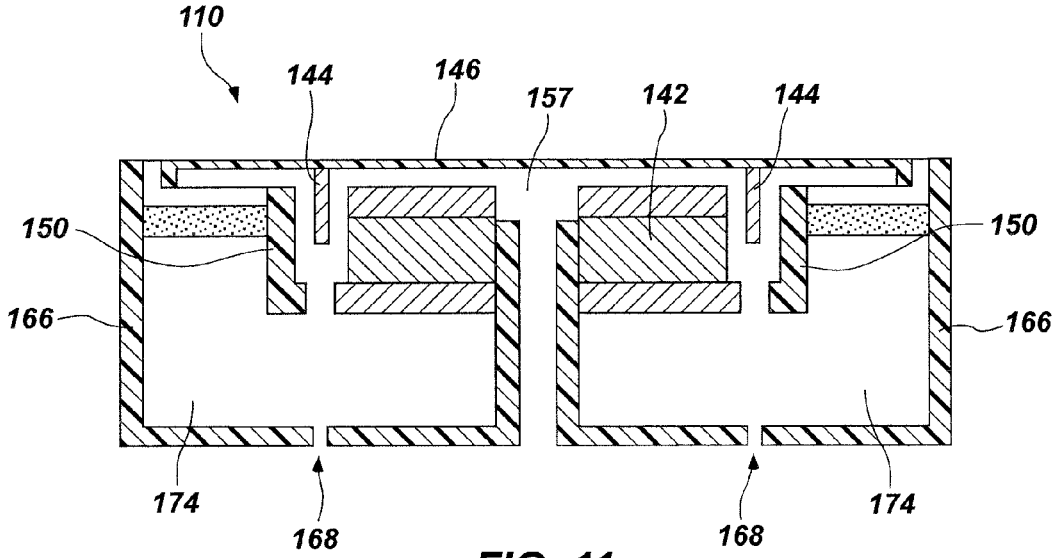
FIG. 11 is a simplified cross-sectional view illustrating another embodiment of an audio driver assembly including a cap attached to an audio driver, which may be employed in the headphone of FIGS. 1, 2A, and 2B.

Referring to FIG. 11, in some embodiments, the cap 166 may have a size selected to define an internal volume 174 within the cap 166, but outside the yoke cup 150. The internal volume 174 may form at least a portion of an acoustical cavity of the audio driver 110, and the size of such an internal volume 174 may be selectively tailored so as to selectively adjust the emitted SPL profile and/or the detectable SPL profile of the audio driver 110 and headphone 100 (FIGS. 1, 2A, and 2B).

Figure 12A:
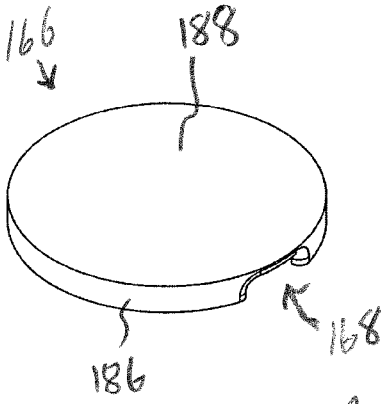
FIG. 12A is a top perspective view illustrating another embodiment of a cap that may be attached to an audio driver and employed in the headphone of FIGS. 1, 2A, and 2B.
Figure 12B:
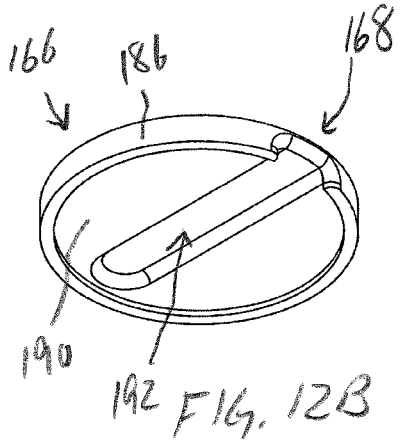
FIG. 12B is a bottom perspective view of the cap of FIG. 12A.
Figure 12C:
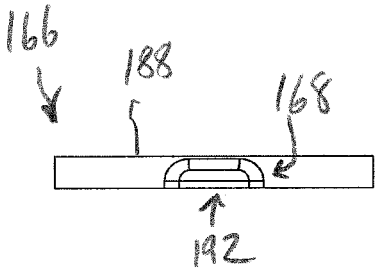
FIG. 12C is a side view of the cap of FIGS. 12A and 12B.
Figure 12D:
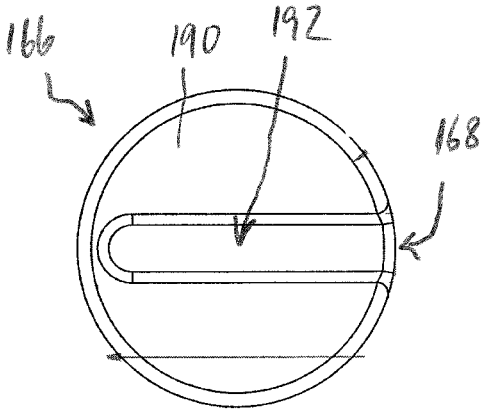
FIG. 12D is bottom plan view of the cap of FIGS. 12A through 12C.

FIGS. 12A through 12D illustrate another embodiment of the cap 166. As shown in FIGS. 12A through 12D, the cap 166 may have an outer port or aperture 168 that extends through a lateral side surface 186 of the cap 166. The cap 166 includes a major back surface 188, and an inner surface 190 (FIGS. 12B and 12D). The inner surface 190 may be configured to abut against and rest on a back surface of the yoke cup 150 of the audio driver 110 (e.g., FIGS. 6-11). A recess 192 may be formed into the inner surface 190, and the recess 192 may extend laterally along the inner surface 190 to, and through, the side surface 186 so as to define the port or aperture 168. The recess 192 may be located and configured such that at least one port 168 extending through the yoke cup 150 opens into the recess 192, such that the recess 192 and the port 168 provide communication between the space 157 (FIGS. 6-11) and the exterior of the cap 166. In this configuration, the recess 192 and the port or aperture 168 may be sized and configured to provide a desirable emitted SPL profile and/or detectable SPL profile to the audio driver 110 and/or the headphone 100 (FIGS. 1, 2A, and 2B).

Figure 13:
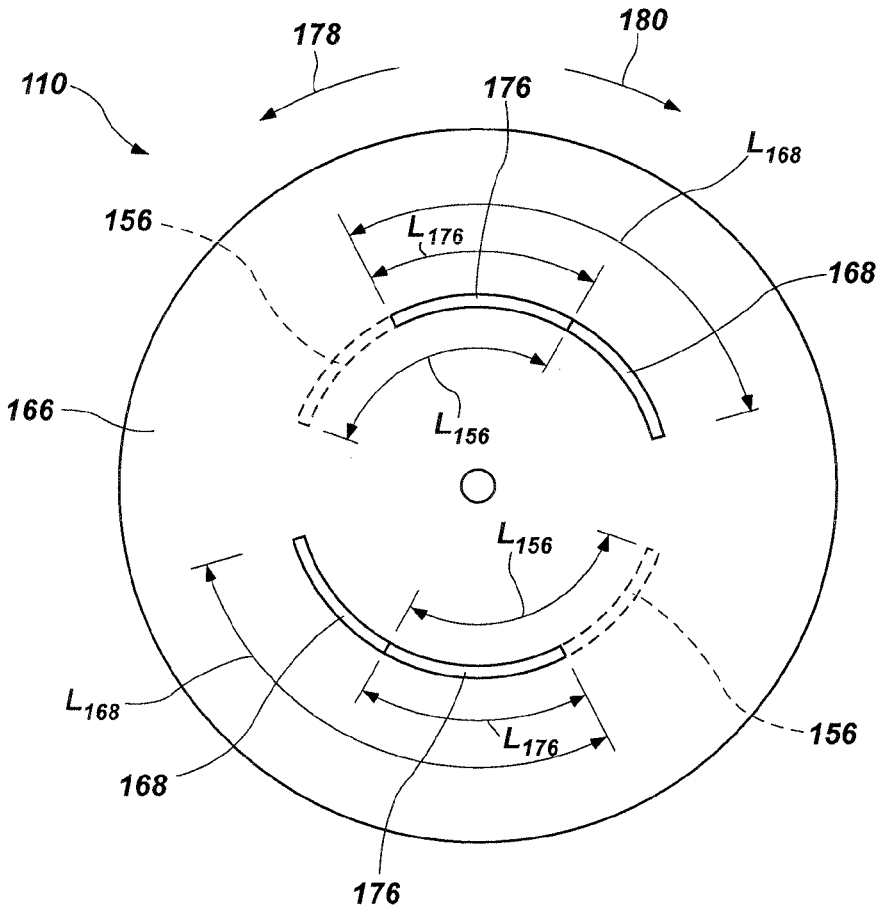
FIG. 13 is a simplified plan view illustrating another embodiment of an audio driver assembly including a cap attached to an audio driver, which may be employed in the headphone of FIGS. 1, 2A, and 2B.

As previously mentioned, in some embodiments, the cap 166 may be adjustable, such that adjustment of the cap 166 causes adjustment of an emitted SPL profile and/or a detectable SPL profile of the audio driver 110 and headphone 100. For example, in some embodiments, the cap 166 may comprise ports or apertures 168 that may be selectively opened or closed. For example, as shown in FIG. 13, the ports or apertures 168 in the cap 166 may have a segmented annular shape. Ports 156 in the yoke cup 150 (FIGS. 6-11) also may have a segmented annular shape, and may be disposed at the same radial distance from the center of the audio driver 110 as the ports or apertures 168 in the cap 166. As shown in FIG. 13, the ports 156 in the yoke cup 150 may have a first arcuate length $L_{156}$, and the ports or apertures 168 in the cap 166 may have a second arcuate length $L_{168}$. The area of overlap 176 between the ports 156 and the ports or apertures 168 in the cap 166 may define an effective total cross-sectional area of ports between the acoustical cavity within the audio driver 110 and the exterior of the audio driver 110. It will be appreciated that the areas of overlap 176, which extend an arcuate length $L_{176}$, may be increased by rotating the cap 166 in the counter-clockwise direction 178, and may be decreased by rotating the cap 166 relative to the audio driver 110 in the clockwise direction 180. In this manner, a cross-sectional area of the ports 156, 168 may be selectively adjusted at any position between a fully open position and a fully closed position. In other words, by selectively rotating the cap 166 relative to the audio driver 110 to which it is attached, the emitted SPL profile and/or the detectable SPL profile of the audio driver 110 and headphone 100 may be selectively adjusted.

Figure 14A:
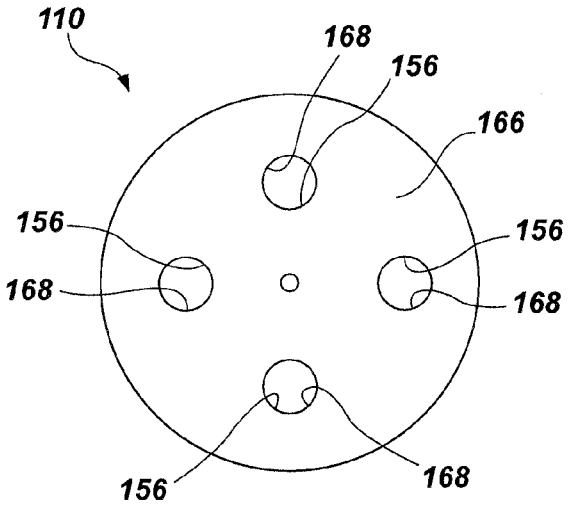
FIG. 14A is a simplified plan view illustrating another embodiment of an audio driver assembly including a cap attached to an audio driver, which may be employed in the headphone of FIGS. 1, 2A, and 2B, and illustrates ports in the cap in an open configuration.
Figure 14B:
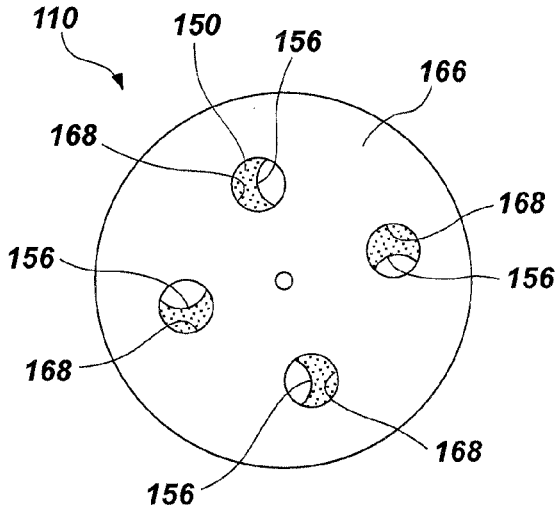
FIG. 14B illustrates the audio driver assembly of FIG. 14A with the cap rotated to a position at which the ports in the cap are partially open.
Figure 14C:
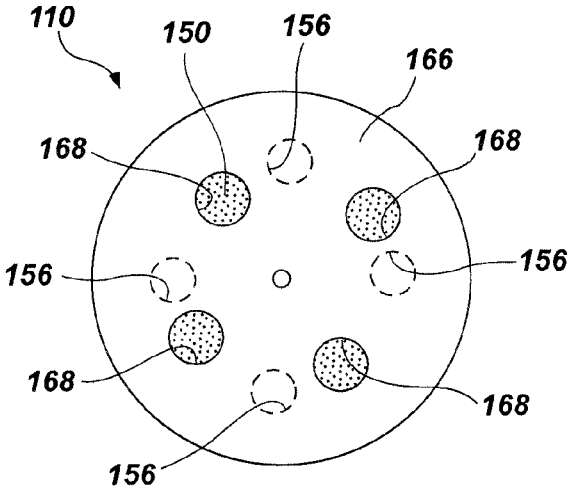
FIG. 14C illustrates the audio driver assembly of FIGS. 14A and 14B with the cap rotated to a position at which the ports in the cap are closed.

FIGS. 14A through 14C illustrate another embodiment in which a cap 166 having ports or apertures 168 therethrough is attached over a back side of an audio driver 110. The ports or apertures 168, however, have a circular shape. Ports 156 in the yoke cup 150 (FIGS. 14B and 14C) also may have a circular shape, and may be disposed at the same radial distance from the center of the audio driver 110 as the ports or apertures 168 in the cap 166. In this configuration, by rotating the cap 166 relative to the audio driver 110, the ports 168 in the cap 166 may be selectively moved between an open state and a closed state. For example, as shown in FIG. 14A, the cap 166 may be rotated relative to the audio driver 110 such that the ports 168 in the cap 166 are rotationally aligned with the ports 156 in the yoke cup 150 (not visible in FIG. 14A). In this configuration, the ports 168 are fully open. As shown in FIG. 14B, the cap 166 may be rotated relative to the audio driver 110 such that the ports 168 in the cap 166 partially overlap with the ports 156 in the yoke cup 150. In this configuration, the ports 168 are partially open and partially closed. As shown in FIG. 14C, the cap 166 may be rotated relative to the audio driver 110 such that the ports 168 in the cap 166 do not overlap to any extent with the ports 156 in the yoke cup 150. In this configuration, the ports 168 are fully closed.

As discussed above with reference to FIG. 13, the area of overlap between the ports 156 and the ports or apertures 168 in the cap 166 may define an effective total cross-sectional area of ports between the acoustical cavity within the audio driver 110 and the exterior of the audio driver 110. The areas of overlap may be selectively increased or decreased by rotating the cap 166 relative to the audio driver 110. In this manner, a cross-sectional area of the ports 156, 168 may be selectively adjusted at any position between the fully open position (FIG. 14A) and the fully closed position (FIG. 14C). In other words, by selectively rotating the cap 166 relative to the audio driver 110 to which it is attached, the emitted SPL profile and/or the detectable SPL profile of the audio driver 110 and headphone 100 (FIGS. 1, 2A, and 2B) may be selectively adjusted.

It will be appreciated that, in the embodiments of FIGS. 13 and 14A through 14C, the ports 168 in the cap 166 are selectively aligned with the ports 156 in the yoke cup 150. In additional embodiments, the cap 166 may include two or more members that may be rotated or otherwise moved relative to one another so as to selectively open and/or close the ports 168 in the cap 166, rather than moving the apertures 168 relative to the ports 156 in the yoke cup 150. In such embodiments, the relative position between the apertures 168 and the ports 156 in the yoke cup 150 may not affect the emitted SPL profile and/or the detectable SPL profile of the audio driver 110 and headphone 100.

Figure 15:
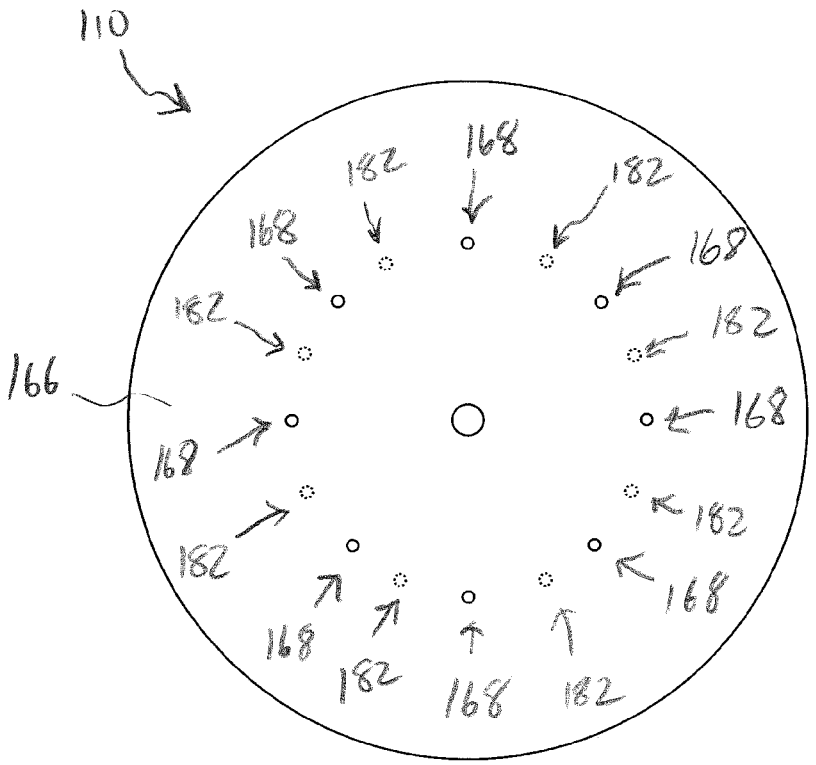
FIG. 15 is a simplified plan view illustrating another embodiment of an audio driver assembly including a cap attached to an audio driver, which may be employed in the headphone of FIGS. 1, 2A, and 2B.

FIG. 15 is a plan view of another embodiment in which the cap 166 includes a plurality of perforated or otherwise weakened regions 182, which may be selectively removed by the manufacturer, a repairman, or an end user, so as to selectively form apertures or ports 168 through the cap 166 so as to selectively adjust the emitted SPL profile and/or the detectable SPL profile of the audio driver 110 and headphone 100 (FIGS. 1, 2A, and 2B). For example, one or more of the weakened regions 182 may be removed by punching the regions 182 out from the cap 166 either manually, using a handheld tool, or an automated machine. In other embodiments, a laser ablation process or a mechanical drilling process, for example, may be used to remove one or more of the regions 182.

In this configuration, by removing additional perforated or otherwise weakened regions 182, the effective cross-sectional area of the ports between the interior and exterior of the audio driver 110 may increased, thereby selectively adjusting the emitted SPL profile and/or the detectable SPL profile of the audio driver 110 and headphone 100 (FIGS. 1, 2A, and 2B).

Figure 16:
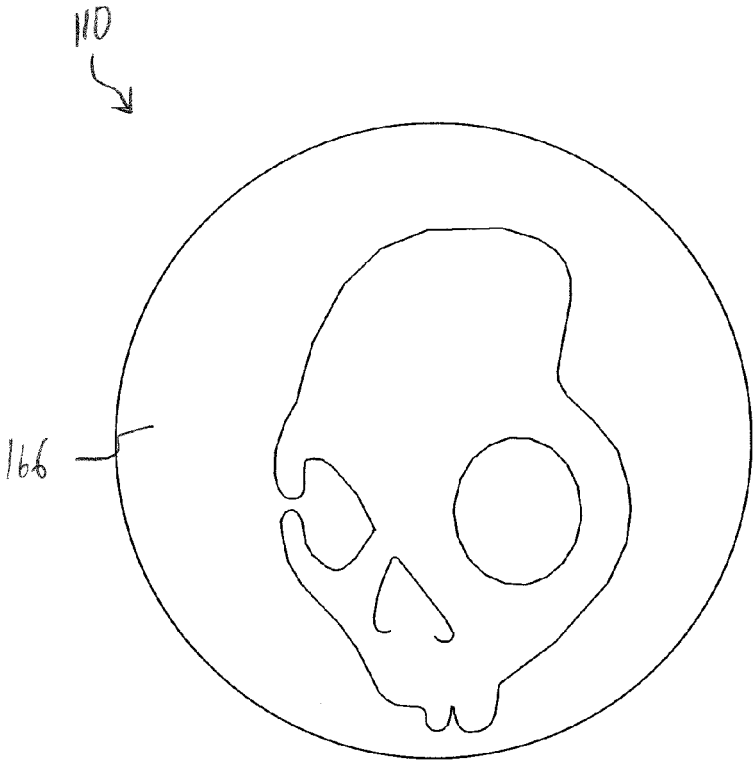
FIG. 16 is a simplified plan view illustrating another embodiment of an audio driver assembly including a cap attached to an audio driver, which may be employed in the headphone of FIGS. 1, 2A, and 2B.

FIG. 16 illustrates another embodiment in which the cap 166 is merely decorative and has an aesthetic decoration thereon, as previously described, and does not include any ports or apertures 168 therethrough, and is not adjustable. In yet further embodiments, any of the caps 166 described herein may be decorative and may include ports or apertures 168, and the ports or apertures may or may not be adjustable as described herein.

In addition, caps 166 as described herein may be employed on any type of audio driver for a headphone, irrespective of whether or not the audio driver is configured to be removable, as described in relation to the audio driver 110 with reference to FIGS. 3 through 5.

Figure 17:
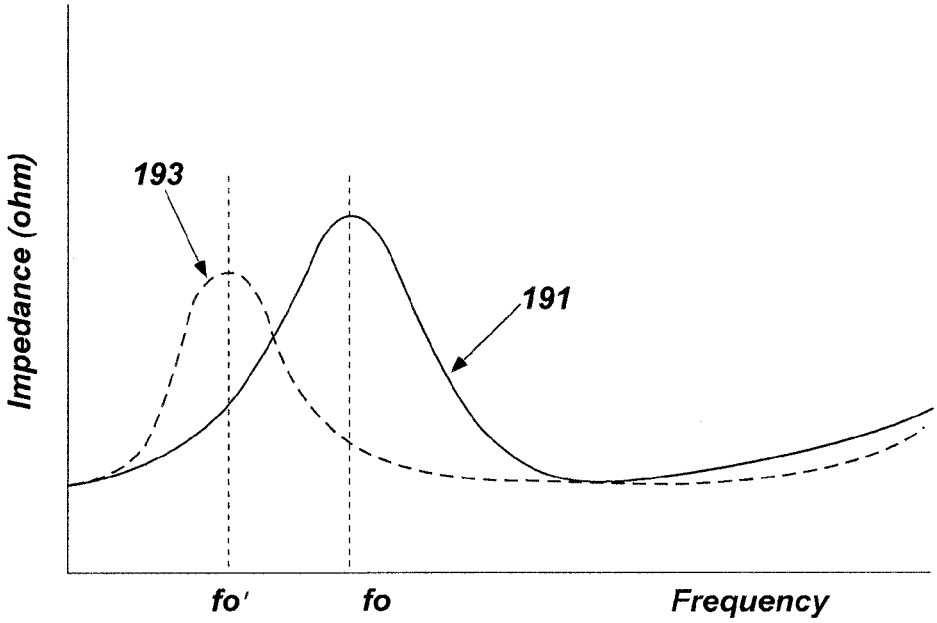
FIG. 17 is a simplified graph illustrating how a cap, such as those shown in FIGS. 7 through 16, may affect the free-air electrical impedance response of an audio driver to which it may be attached.
Figure 18:
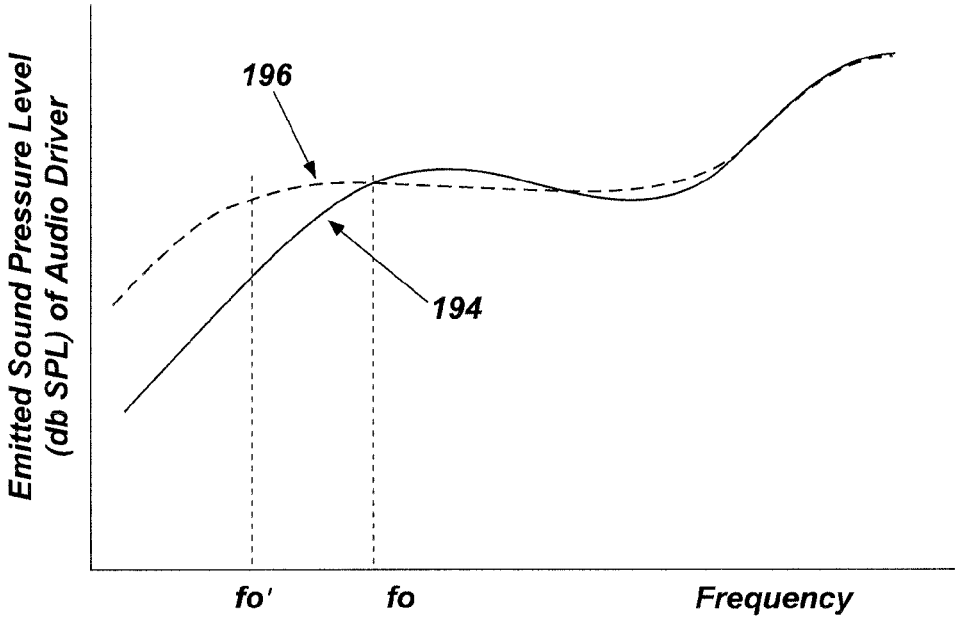
FIG. 18 is a simplified graph illustrating how a cap, such as those shown in FIGS. 7 through 16, may affect an emitted sound pressure level (SPL) profile of an audio driver to which it may be attached.
Figure 19:
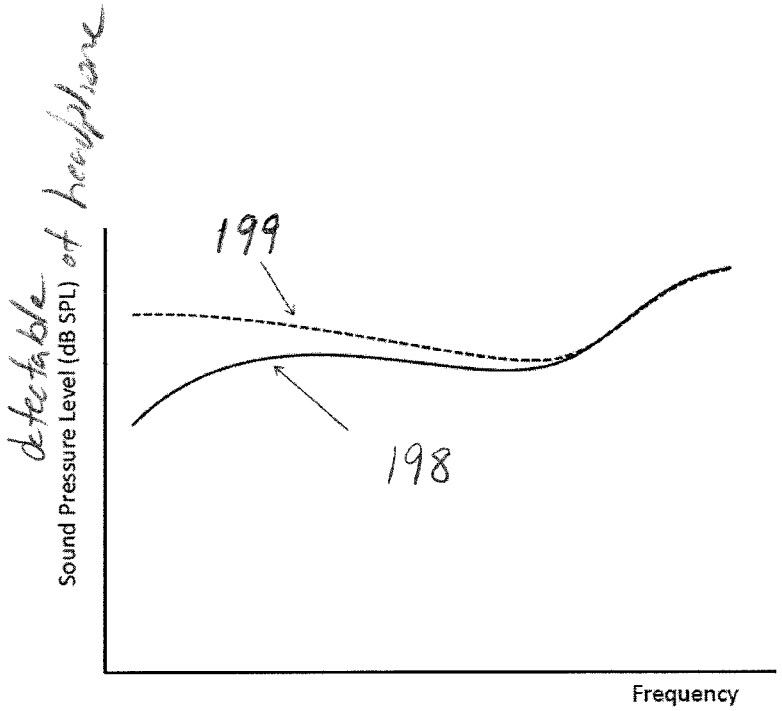
FIG. 19 is a simplified graph illustrating how a cap, such as those shown in FIGS. 7 through 16, may affect an emitted sound pressure level (SPL) profile of a headphone including an audio driver to which the cap may be attached.

FIGS. 17 through 19 are graphs illustrating how the presence of a cap 166 as described herein may affect the acoustic response of the audio driver 110 and/or the headphone 100.

Line 191 in FIG. 17 represents how the electrical impedance of the audio driver 110 as a function of frequency may appear when measured in the absence of a cap 166, while line 193 in FIG. 17 represents how the electrical impedance of the audio driver 110 as a function of frequency may appear when measured with the cap 166 secured to the audio driver 110 over the back side 162 thereof, as described above. As shown in FIG. 17, the peak frequency $f_0$ may be shifted to a relatively lower frequency $f_{0'}$ when the cap 166 is secured to the audio driver 110 over the back side 162 thereof.

Line 194 in FIG. 18 represents how the emitted SPL profile of the audio driver 110 may appear when measured in the absence of a cap 166, while line 196 in FIG. 18 represents how the emitted SPL profile of the audio driver 110 may appear when measured with the cap 166 secured to the audio driver 110 as described above. As shown in FIG. 18, the sound pressure level of at least some frequencies may be increased, and particularly over low (bass) frequencies (e.g., frequencies of about 16 Hz to approximately 512 Hz), when the cap 166 is secured to the audio driver 110 over the back side 162 thereof, compared to the audio driver 110 in the absence of the cap 166.

Line 198 in FIG. 19 represents how the detectable SPL profile of the headphone 100 may appear when measured in the absence of a cap 166 on the audio driver 110, while line 199 in FIG. 19 represents how the detectable SPL profile of the headphone 100 may appear when measured with the cap 166 secured to the audio driver 110 as described above. As shown in FIG. 19, the sound pressure level of at least some frequencies may be increased, and particularly over low (bass) frequencies (e.g., frequencies of about 16 Hz to approximately 512 Hz), when the cap 166 is secured to the audio driver 110 over the back side 162 thereof, compared to the audio driver 110 in the absence of the cap 166.

Additional embodiments of the disclosure include driver assemblies for use in headphones that are configured such that a port of a driver unit of the driver assembly is open to an exterior of a headphone in which it is to be received without communicating acoustically with any volume outside the driver assembly within the outer ear-cup housing of the headphone.

Figure 20:
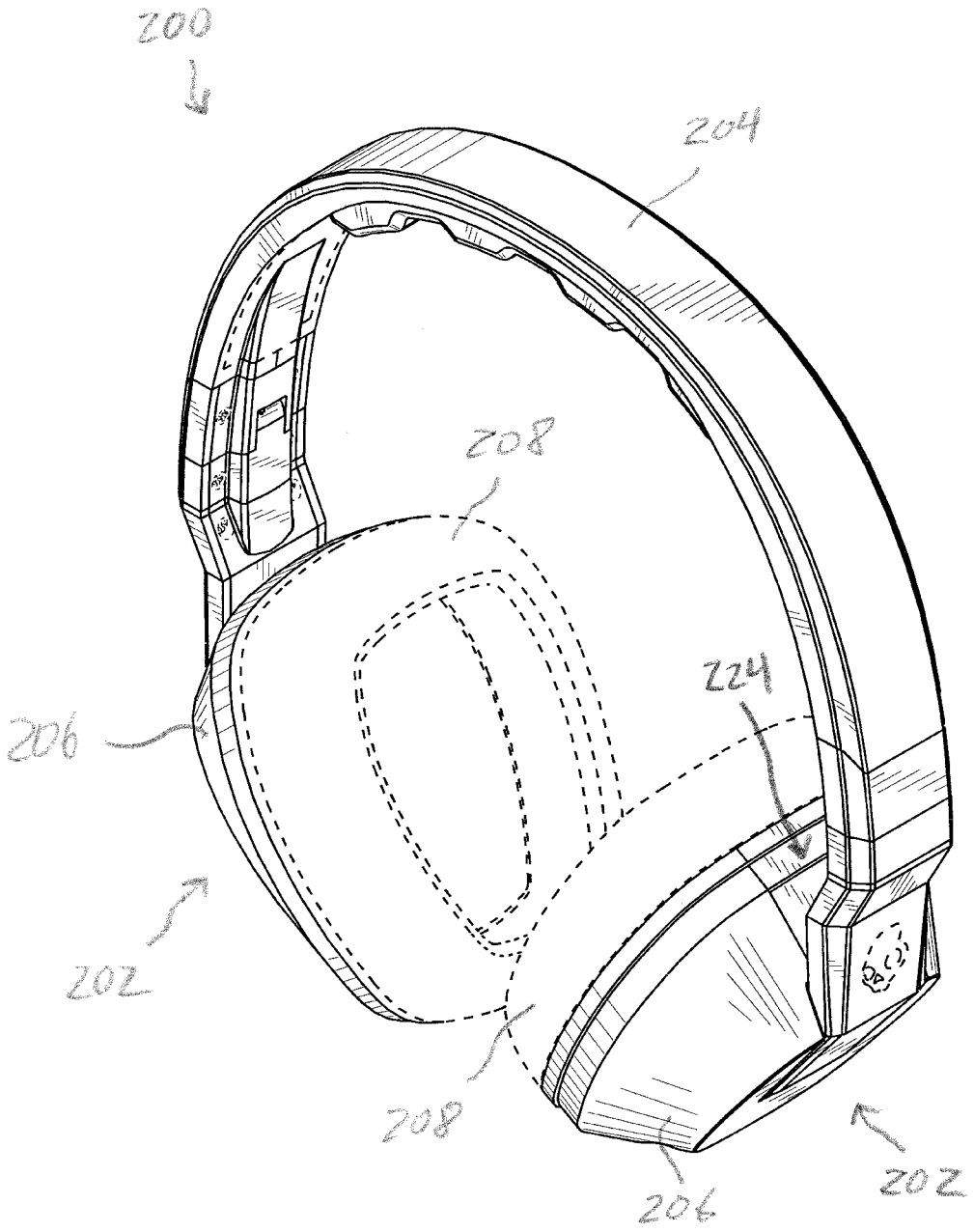
FIG. 20 is a perspective view of an embodiment of a headphone of the present disclosure that includes an audio driver assembly as described herein.

For example, FIG. 20 illustrates an additional embodiment of a headphone 200 of the present disclosure. The headphone 200 is similar to the headphone 100 previously described with reference to FIG. 1, and includes two ear-cup assemblies 202 that are connected with a headband 204, which rests on the head of the user and supports the ear-cup assemblies 202 over or on the ears of the user. Each ear-cup assembly 202 includes an outer ear-cup housing 206, and may include a cushion 208 attached to or otherwise carried on the outer ear-cup housing 206. The headphone 200 may be configured to receive an electronic audio signal from a media player, either through a wired connection or a wireless connection between the headphone 200 and the media player.

Figure 21A:
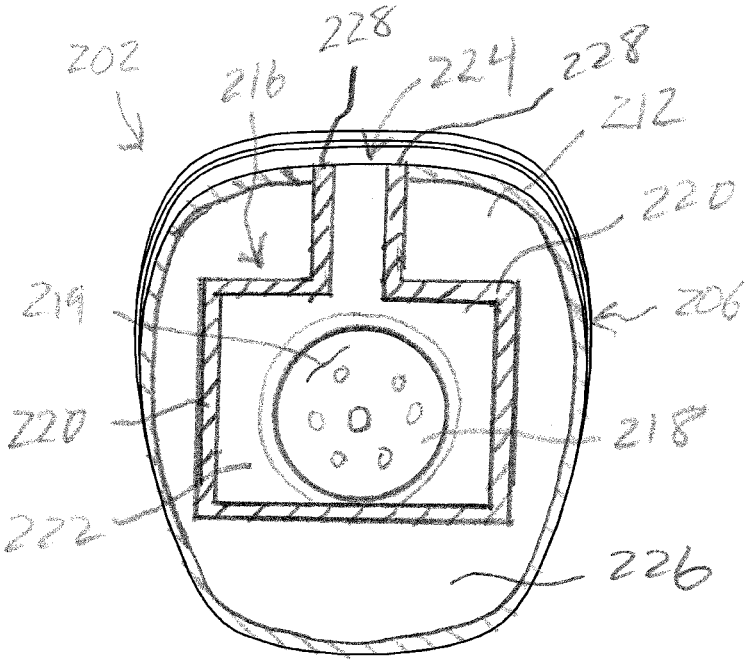
FIG. 21A is a simplified and schematic illustration of a cross-sectional view of an ear-cup assembly that includes a driver assembly in accordance with another embodiment of a headphone of the present disclosure.
Figure 21B:
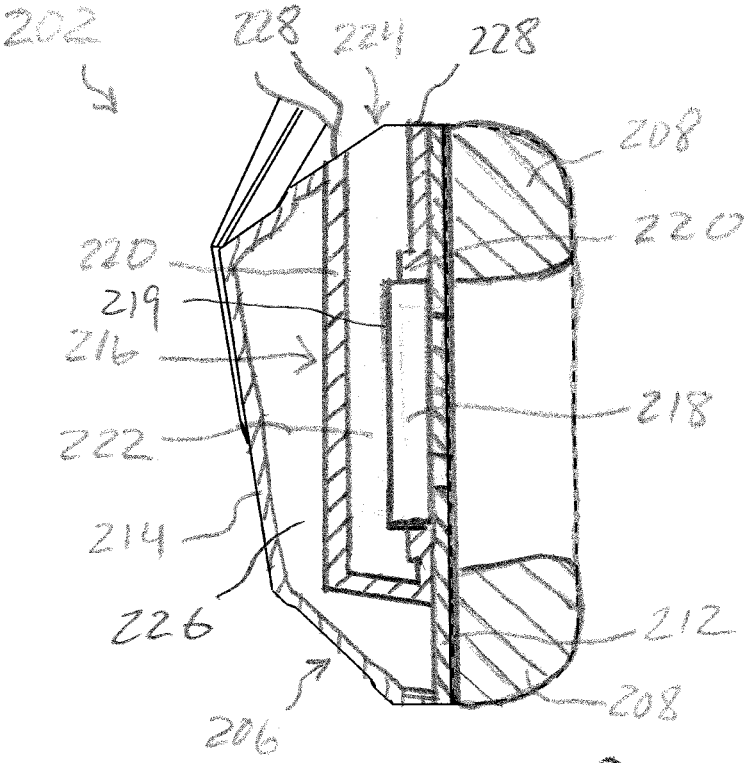
FIG. 21B is a cross-sectional view of the ear-cup assembly of FIG. 21A in a plane transverse to the plane of view of FIG. 21A.

FIGS. 21A and 21B are simplified representations of cross-sectional views of one of the ear-cup assemblies 202 of the headphone 200 of FIG. 20. As shown in FIGS. 21A and 21B, the outer ear-cup housing 206 may include two or more members that are assembled together to form the outer ear-cup housing 206. As a non-limiting example, the outer ear-cup housing 206 may include a front member 212 and a back member 214. The various members of the outer ear-cup housing 206 may be formed from, for example, plastic or metal, and may serve as a frame structure for the ear-cup assembly 202.

In accordance with some embodiments of the present invention, the ear-cup assembly 202 includes a driver assembly 216. The driver assembly 216 includes an audio driver 218 secured within a driver unit housing 220. The driver unit housing 220 defines an acoustical cavity 222 between the driver unit housing 220 and the audio driver 218. In other words, the driver unit housing 220 may comprise an enclosure in which the audio driver 218 may be disposed within the ear-cup assembly 202. The driver unit housing 220 has a port 224 extending through the driver unit housing 220 between the acoustical cavity 222 and the exterior of the driver assembly 216. Moreover, the driver unit housing 220 is configured to be secured within the outer ear-cup housing 206 of the ear-cup assembly 202 of the headphone 200 such that the port 224 in the driver unit housing 220 is open to the exterior of the headphone 200 without communicating acoustically with any volume outside the driver assembly 216 within the outer ear-cup housing 206 of the headphone 200, such as the volume of space 226 within the outer ear-cup housing 206 that is outside the driver assembly 216. In this configuration, the acoustical cavity 222 is defined between the driver unit housing 220 and a back side 219 of the audio driver 218.

The audio driver 218 may comprise an audio driver 110 as previously described herein. For example, in some embodiments, the audio driver 218 may be removable and configured for attachment to wires or other electrical conductors using a detachable and solderless coupling, as previously described with reference to FIGS. 1 through 6. Optionally, the audio driver 218 may include a cap 166 as previously described with reference to FIGS. 7 through 19. In other embodiments of the present disclosure, the audio driver 218 may comprise any type of audio driver known in the art.

As the port 224 of the driver unit housing 220 opens to the exterior of the ear-cup assembly 202 rather than to a volume of space within the outer ear-cup housing 206, at least one surface 228 of the driver unit housing 220 may be configured to define an exterior surface of the ear-cup assembly 202 of the headphone 200, and the port 224 may extend through the at least one surface 228 of the driver unit housing 220.

Since the acoustical cavity 222 of the driver assembly 216 does not communicate acoustically with any volume of space outside the driver assembly 216 within the outer ear-cup housing 206 of the ear-cup assembly 202, the driver unit housing 220 and the audio driver 218 may be designed and configured together to provide a desirable emitted SPL profile and/or a desirable detectable SPL profile, and the desirable emitted SPL profile and/or desirable detectable SPL profile may be at least substantially independent of the configuration of the ear-cup assembly 202 of the headphone 200 in which the driver assembly 216 is to be installed. As a result, a variety of different configurations and/or sizes of ear-cup assemblies and headphones may be designed and configured to receive a standardized driver assembly 216 having a common configuration therein, and the emitted SPL profile and/or desirable detectable SPL profile may remain at least substantially the same regardless of the configuration and/or size of the ear-cup assembly 202 in which the driver assembly 216 is installed and employed.

Figure 22:
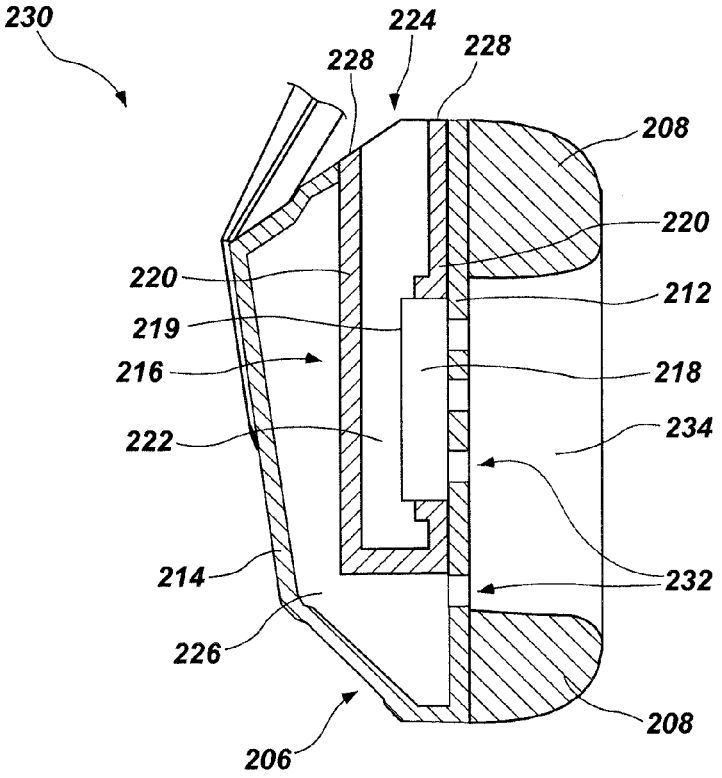
FIG. 22 is a simplified and schematic illustration of a cross-sectional view of another ear-cup assembly that includes a driver assembly in accordance with another embodiment of a headphone of the present disclosure.

FIG. 22 illustrates an additional embodiment of an ear-cup assembly 230, which is similar to the ear-cup assembly 202 of FIGS. 21A and 21B, and which may be employed in a headphone such as the headphone 200 of FIG. 20, but which includes an aperture or port 232 extending through the front member 212 of the outer ear-cup housing 206 at a location providing communication between a space 234 and the volume of space 226 within the outer ear-cup housing 206 that is outside the audio driver assembly 216. The space 234 is the space that is defined within the cushion 208 between the exterior surface of the front member 212 of the outer ear-cup housing 206 and the head of a person wearing the headphone 200. This space 234 often forms an acoustical cavity in front of the audio driver 218 adjacent the ear of the person wearing the headphone. By providing one or more ports 232 between the space 234 and the volume of space 226 within the outer ear-cup housing 206 that is outside the audio driver assembly 216, and by locating and configuring the one or more ports 232 to have a desirable location, size, and shape, the acoustic response of the audio driver 218 and/or headphone 200 may be selectively tuned over at least a range of frequencies, and thus may be provided with a desirable detectable SPL profile.

Figure 23:
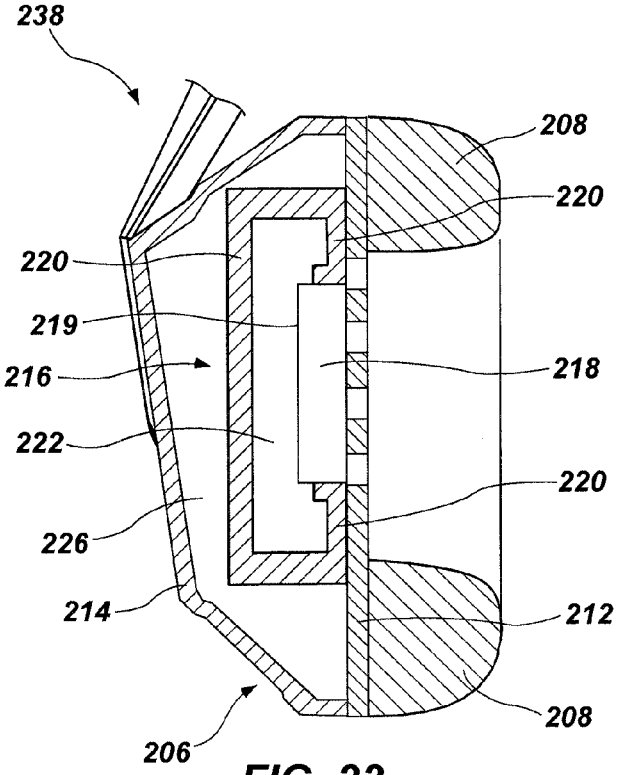
FIG. 23 is a simplified and schematic illustration of a cross-sectional view of another ear-cup assembly that includes a driver assembly in accordance with another embodiment of a headphone of the present disclosure.

FIG. 23 illustrates an additional embodiment of an ear-cup assembly 238, which is similar to the ear-cup assembly 202 of FIGS. 21A and 21B, and which may be employed in a headphone such as the headphone 200 of FIG. 20, but wherein the audio driver assembly 216 is an enclosed audio driver assembly 216 that does not include a port 224 (FIGS. 20, 21A and 21B). As a result, the acoustical cavity 222 is at least substantially enclosed and sealed within the driver unit housing 220 of the driver assembly 216. By selectively configuring the driver unit housing 220 of the driver assembly 216 and the acoustical cavity 222 defined therein, the acoustic response of the audio driver 218 and/or headphone 200 may be selectively tuned over at least a range of frequencies, and thus may be provided with a desirable detectable SPL profile. In addition, since the acoustical cavity 222 of the driver assembly 216 does not communicate acoustically with any volume of space outside the driver assembly 216 within the outer ear-cup housing 206 or outside the outer ear-cup housing 206 of the ear-cup assembly 238, the emitted SPL profile and/or detectable SPL profile of the driver assembly 216 may be at least substantially independent of the configuration of the outer ear-cup housing 206 of the ear-cup assembly 238 of the headphone 200 in which the driver assembly 216 is installed.

Additional non-limiting example embodiments of the disclosure are set forth below.

Embodiment 1

A headphone comprising a removable audio driver having terminals electrically coupled to electrical conductors configured to carry an electrical audio signal to the audio driver, the terminals of the audio driver coupled to the electrical conductors with a solderless and detachable electrical coupling.

Embodiment 2

The headphone of Embodiment 1, wherein the electrical conductors comprise wires.

Embodiment 3

The headphone of Embodiment 1 or Embodiment 2, wherein the solderless and detachable electrical coupling comprises a plug-and-receptacle coupling.

Embodiment 4

The headphone of any one of Embodiments 1 through 3, wherein the solderless and detachable electrical coupling comprises a spring contact.

Embodiment 5

The headphone of any one of Embodiments 1 through 3, wherein the solderless and detachable electrical coupling comprises a magnetic coupling.

Embodiment 6

The headphone of any one of Embodiments 1 through 5, further comprising a cap over a back side of the audio driver.

Embodiment 7

The headphone of Embodiment 6, wherein the headphone further comprises an ear-cup housing, at least a portion of the ear-cup housing being at least partially transparent such that the cap over the back side of the audio driver is visible through the at least a portion of the ear-cup housing from the exterior of the headphone.

Embodiment 8

The headphone of Embodiment 6 or Embodiment 7, wherein the cap has at least one aesthetic decoration thereon.

Embodiment 9

The headphone of any one of Embodiments 6 through 8, wherein the cap at least partially defines an acoustical cavity of the audio driver.

Embodiment 10

The headphone of any one of Embodiments 6 through 9, wherein the cap is directly coupled to the audio driver.

Embodiment 11

The headphone of any one of Embodiments 6 through 10, wherein the cap is adjustable, adjustment of the cap causing adjustment of a detectable sound pressure level (SPL) profile of the headphone.

Embodiment 12

The headphone of Embodiment 11, wherein the cap comprises a port configured to be opened or closed.

Embodiment 13

The headphone of Embodiment 11 or Embodiment 12, wherein the cap comprises a port having an adjustable cross-sectional area.

Embodiment 14

The headphone of Embodiment 13, wherein the cross-sectional area of the port is adjustable by rotating the cap relative to the audio driver.

Embodiment 15

A headphone, comprising: an audio driver having terminals electrically coupled to electrical conductors configured to carry an electrical audio signal to the audio driver; and a cap coupled directly to the audio driver and disposed over a back side of the audio driver.

Embodiment 16

The headphone of Embodiment 15, wherein the cap is not a portion of an outer ear-cup housing of an ear-cup assembly of the headphone.

Embodiment 17

The headphone of Embodiment 15, wherein the headphone further comprises an ear-cup housing, at least a portion of the ear-cup housing being at least partially transparent such that the cap is visible through the at least a portion of the ear-cup housing from the exterior of the headphone.

Embodiment 18

The headphone of Embodiment 17, wherein the cap has at least one aesthetic decoration thereon.

Embodiment 19

The headphone of Embodiment 15, wherein the cap has at least one aesthetic decoration thereon.

Embodiment 20

The headphone of Embodiment 15, wherein the cap at least partially defines an acoustical cavity of the audio driver.

Embodiment 21

The headphone of Embodiment 20, wherein the cap is adjustable, adjustment of the cap causing adjustment of a detectable sound pressure level (SPL) profile of the headphone.

Embodiment 22

The headphone of Embodiment 21, wherein the cap comprises a port configured to be opened or closed.

Embodiment 23

The headphone of Embodiment 21, wherein the cap comprises a port having an adjustable cross-sectional area.

Embodiment 24

The headphone of Embodiment 23, wherein the cross-sectional area of the port is adjustable by rotating the cap relative to the audio driver.

Embodiment 25

The headphone of Embodiment 15, wherein the audio driver is removable from the headphone without causing damage to any component of the headphone.

Embodiment 26

The headphone of Embodiment 25, wherein the terminals of the audio driver are coupled to the electrical conductors with a solderless and detachable electrical coupling.

Embodiment 27

A driver assembly for a headphone, comprising: an audio driver; and a driver unit housing attached to the audio driver, the driver unit housing defining an acoustical cavity between the driver unit housing and the audio driver, the driver unit housing having a port extending through the driver unit housing between the acoustical cavity and an exterior of the driver assembly, the driver unit housing configured to be secured within an outer ear-cup housing of a headphone such that the port in the driver unit housing is open to the exterior of the headphone without communicating acoustically with any volume outside the driver assembly within the outer ear-cup housing of the headphone.

Embodiment 28

The driver assembly of Embodiment 27, wherein at least one surface of the driver unit housing is configured to define an exterior surface of a headphone configured to receive the driver assembly therein, the port extending through the at least one surface of the driver unit housing.

Embodiment 29

The driver assembly of Embodiment 27 or Embodiment 28, wherein the acoustical cavity is defined as between the driver unit housing and a back side of the audio driver.

Embodiment 30

The driver assembly of any one of Embodiments 27 through 29, wherein the driver assembly is configured such that a detectable sound pressure level (SPL) profile of the driver assembly is at least substantially independent of a configuration of a headphone in which the driver assembly is to be received.

Embodiment 31

The driver assembly of any one of Embodiments 27 through 30, wherein the audio driver is removable from the driver assembly without destructing the driver assembly, the audio driver having terminals electrically coupled to electrical conductors configured to carry an electrical audio signal to the audio driver, the terminals of the audio driver coupled to the electrical conductors with a solderless and detachable electrical coupling.

Embodiment 32

The driver assembly of any one of Embodiments 27 through 31, further comprising a cap over a back side of the audio driver, the cap disposed within the driver unit housing.

Embodiment 33

The driver assembly of Embodiment 32, wherein the cap has at least one aesthetic decoration thereon.

Embodiment 34

The driver assembly of Embodiment 32 or Embodiment 33, wherein the cap at least partially defines another acoustical cavity of the audio driver.

Embodiment 35

The driver assembly of any one of Embodiments 32 through 34, wherein the cap is directly coupled to the audio driver.

Embodiment 36

The driver assembly of any one of Embodiments 32 through 35, wherein the cap is adjustable, adjustment of the cap causing adjustment of a detectable sound pressure level (SPL) profile of the driver assembly.

Embodiment 37

The driver assembly of Embodiment 36, wherein the cap comprises a port configured to be opened or closed.

Embodiment 38

The driver assembly of Embodiment 36 or Embodiment 37, wherein the cap comprises a port having an adjustable cross-sectional area.

Embodiment 39

The driver assembly of Embodiment 38, wherein the cross-sectional area of the port is adjustable by rotating the cap relative to the audio driver.

Embodiment 40

A headphone, comprising: an outer ear-cup housing; and a driver assembly disposed within the outer ear-cup housing, the driver assembly including an audio driver attached to a driver unit housing, the driver unit housing defining an acoustical cavity between the driver unit housing and the audio driver, the driver unit housing having a port extending through the driver unit housing between the acoustical cavity and an exterior of the driver unit housing without communicating acoustically with a volume of space inside the outer ear-cup housing and outside the driver assembly.

Embodiment 41

The headphone of Embodiment 40, wherein at least one surface of the driver unit housing is configured to define an exterior surface of a headphone configured to receive the driver assembly therein, the port extending through the at least one surface of the driver unit housing.

Embodiment 42

The headphone of Embodiment 40 or Embodiment 41, wherein the acoustical cavity is defined between the driver unit housing and a back side of the audio driver.

Embodiment 43

The headphone of any one of Embodiments 40 through 42, wherein the driver assembly is configured such that a detectable sound pressure level (SPL) profile of the driver assembly is at least substantially independent of a configuration of a headphone in which the driver assembly is to be received.

Embodiment 44

The headphone of any one of Embodiments 40 through 43, wherein the audio driver is removable from the driver assembly without destructing the driver assembly, the audio driver having terminals electrically coupled to electrical conductors configured to carry an electrical audio signal to the audio driver, the terminals of the audio driver coupled to the electrical conductors with a solderless and detachable electrical coupling.

Embodiment 45

The headphone of any one of Embodiments 40 through 44, further comprising a cap over the back side of the audio driver, the cap disposed within the driver unit housing.

Embodiment 46

A method of forming a headphone comprising detachably and solderlessly coupling electrical terminals of an audio driver to electrical conductors configured to carry an electrical audio signal to the audio driver within an outer ear-cup housing of a headphone.

Embodiment 47

The method of Embodiment 46, wherein detachably and solderlessly coupling the electrical terminals of the audio driver to the electrical conductors comprises magnetically coupling the electrical terminals of the audio driver to the electrical conductors.

Embodiment 48

The method of Embodiment 46 or Embodiment 47, further comprising attaching a cap to the audio driver over a back side of the audio driver.

Embodiment 49

The method of Embodiment 48, wherein the cap is adjustable, and wherein the method further comprises adjusting a detectable sound pressure level (SPL) profile of the headphone by adjusting the cap.

Embodiment 50

The method of Embodiment 49, wherein adjusting the cap comprises opening or closing a port extending through the cap.

Embodiment 51

The method of Embodiment 49 or Embodiment 50, wherein adjusting the cap comprises rotating the cap relative to the audio driver.

Embodiment 52

A method of forming a driver assembly for a headphone, comprising: attaching an audio driver to a driver unit housing and providing an acoustical cavity between the driver unit housing and the audio driver, the driver unit housing having a port extending through the driver unit housing between the acoustical cavity and an exterior of the driver assembly, the driver unit housing configured to be secured within an outer ear-cup housing of a headphone such that the port in the driver unit housing is open to an exterior of the headphone without communicating acoustically with any volume outside the driver unit housing within the outer ear-cup housing of the headphone.

Embodiment 53

The method of Embodiment 52, further comprising configuring at least one surface of the driver unit housing to define an exterior surface of a headphone configured to receive the driver assembly therein, and configuring the port to extend through the at least one surface of the driver unit housing.

Embodiment 54

The method of Embodiment 52 or Embodiment 53, further comprising configuring the driver assembly such that a detectable sound pressure level (SPL) profile of the driver assembly is at least substantially independent of a configuration of a headphone in which the driver assembly is to be received.

Embodiment 55

The method of any one of Embodiments 52 through 54, wherein attaching the audio driver to the driver unit housing comprises removably attaching the audio driver to the driver unit housing, and electrically coupling electrical terminals of the audio driver to electrical conductors using a solderless and detachable electrical coupling therebetween.

Embodiment 56

The method of any one of Embodiments 52 through 55, further comprising providing a cap over a back side of the audio driver within the driver unit housing.

Embodiment 57

The method of Embodiment 56, further comprising using the cap to form another acoustical cavity of the audio driver between the cap and the audio driver.

Embodiment 58

The method of Embodiment 56 or Embodiment 57, wherein the cap is adjustable, and wherein the method further comprises adjusting the cap to adjust a detectable sound pressure level (SPL) profile of the driver assembly.

Embodiment 59

The method of Embodiment 58, wherein adjusting the cap comprises opening or closing a port extending through the cap.

Embodiment 60

The method of Embodiment 58, wherein adjusting the cap comprises rotating the cap relative to the audio driver to alter a cross-sectional area of at least one port extending through the cap.

Embodiment 61

A method of forming a headphone, comprising: attaching an audio driver to a driver unit housing and providing an acoustical cavity between the driver unit housing and the audio driver, the driver unit housing having a port extending through the driver unit housing between the acoustical cavity and an exterior of the driver unit housing; and securing the audio driver and the driver unit housing within an outer ear-cup housing such that the port in the driver unit housing is open to an exterior of the headphone without communicating acoustically with any volume within the outer ear-cup housing of the headphone outside the acoustical cavity.

Embodiment 62

The method of Embodiment 61, further comprising configuring the driver unit housing and the outer ear-cup housing such that at least one surface of the driver unit housing is exposed to the exterior of the headphone, and configuring the port to extend through the at least one surface of the driver unit housing.

Embodiment 63

The method of Embodiment 61 or Embodiment 62, further comprising configuring the audio driver and the driver unit housing such that a detectable sound pressure level (SPL) profile of the headphone is at least substantially independent of a configuration of the outer ear-cup housing of the headphone.

Embodiment 64

The method of any one of Embodiments 61 through 63, wherein attaching the audio driver to the driver unit housing comprises removably attaching the audio driver to the driver unit housing, and electrically coupling electrical terminals of the audio driver to electrical conductors using a solderless and detachable electrical coupling therebetween.

Embodiment 65

The method of any one of Embodiments 61 through 64, further comprising providing a cap over a back side of the audio driver within the driver unit housing.

Embodiment 66

The method of Embodiment 65, further comprising using the cap to form another acoustical cavity of the audio driver between the cap and the audio driver.

Embodiment 67

The method of Embodiment 65 or Embodiment 66, wherein the cap is adjustable, and wherein the method further comprises adjusting the cap to adjust a detectable sound pressure level (SPL) profile of the of the headphone.

Embodiment 68

The method of Embodiment 67, wherein adjusting the cap comprises opening or closing a port extending through the cap.

Embodiment 69

The method of Embodiment 67 or Embodiment 68, wherein adjusting the cap comprises rotating the cap relative to the audio driver to alter a cross-sectional area of at least one port extending through the cap.

The embodiments of the invention described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosed embodiments, such as alternate useful combinations of the described elements of the embodiments, will become apparent to those skilled in the art from the description. Such modifications are also intended to fall within the scope of the appended claims.

What is claimed is:

1. A headphone, comprising:
an outer ear-cup housing; and
a driver assembly located within the outer ear-cup housing, the driver assembly including:
a driver unit housing attached to the outer ear-cup housing, the driver unit housing defining an acoustical cavity within the driver unit housing, the driver unit housing including:
a port defined by the driver unit housing between the acoustical cavity and the exterior of the outer ear-cup housing without communicating acoustically with a volume of space inside the outer ear-cup housing and outside the driver unit housing; and
a cap located at a back side of the driver unit housing; and
an audio driver having terminals electrically coupled to electrical conductors configured to carry an electrical audio signal to the audio driver;
wherein the cap is coupled directly to the audio driver and disposed over a back side of the audio driver.

2. The headphone of claim 1, wherein the cap is not a portion of an outer ear-cup housing of an ear-cup assembly of the headphone.

3. The headphone of claim 1, wherein at least a portion of the outer ear-cup housing is at least partially transparent such that the cap is visible through the at least a portion of the ear-cup housing from an exterior of the outer ear-cup housing.

4. The headphone of claim 3, wherein the cap has at least one aesthetic decoration thereon.

5. The headphone of claim 1, wherein the cap has at least one aesthetic decoration thereon.

6. The headphone of claim 1, wherein the cap is adjustable, adjustment of the cap causing adjustment of a detectable sound pressure level (SPL) profile of the headphone.

7. The headphone of claim 6, wherein the cap comprises a port configured to be opened or closed.

8. The headphone of claim 6, wherein the cap comprises a port having an adjustable cross-sectional area.

9. The headphone of claim 8, wherein the cross-sectional area of the port is adjustable by rotating the cap relative to the audio driver.

10. The headphone of claim 1, wherein the audio driver is removable from the headphone without causing damage to any component of the headphone.

11. The headphone of claim 10, wherein the terminals of the audio driver are coupled to the electrical conductors with a solderless and detachable electrical coupling.

12. The headphone of claim 11, wherein the solderless and detachable electrical coupling comprises a plug-and-receptacle coupling.

13. The headphone of claim 11, wherein the solderless and detachable electrical coupling comprises a spring contact.

14. The headphone of claim 11, wherein the solderless and detachable electrical coupling comprises a magnetic coupling.

* * * * *